US007313846B2

(12) United States Patent
Stolmeier

(10) Patent No.: US 7,313,846 B2
(45) Date of Patent: Jan. 1, 2008

(54) SLIDERS FOR RECLOSABLE CONTAINERS

(75) Inventor: Robert C. Stolmeier, Shelbyville, IN (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/492,746

(22) PCT Filed: Oct. 16, 2002

(86) PCT No.: PCT/US02/33042

§ 371 (c)(1),
(2), (4) Date: Oct. 12, 2004

(87) PCT Pub. No.: WO03/033359

PCT Pub. Date: Apr. 24, 2003

(65) Prior Publication Data

US 2005/0041892 A1 Feb. 24, 2005

Related U.S. Application Data

(60) Provisional application No. 60/330,140, filed on Oct. 17, 2001.

(51) Int. Cl.
*A44B 19/26* (2006.01)
*B65D 33/16* (2006.01)

(52) U.S. Cl. ..... 24/30.5 R; 24/400; 383/61.3; 383/64

(58) Field of Classification Search ..... 24/585.1, 24/399, 585.11, 585.12, 400, 415, 426–428, 24/30.5 R; 383/63, 64, 61.1, 61.2, 61.363
See application file for complete search history.

(56) References Cited

U.S. PATENT DOCUMENTS

| | | | |
|---|---|---|---|
| 2,568,163 | A | 9/1951 | Morin |
| 2,620,535 | A | 12/1952 | Steiner |
| 2,994,469 | A | 8/1961 | Troup et al. |
| 3,122,807 | A | 3/1964 | Ausnit |
| 3,173,184 | A | 3/1965 | Ausnit |
| 3,426,396 | A | 2/1969 | Laguerre |
| 3,579,747 | A | 5/1971 | Hawley |
| 3,660,875 | A | 5/1972 | Gutman |
| 3,713,923 | A | 1/1973 | Laguerre |
| 4,199,845 | A | 4/1980 | Ausnit |
| 4,212,337 | A | 7/1980 | Kamp |

(Continued)

FOREIGN PATENT DOCUMENTS

| | | | |
|---|---|---|---|
| EP | 0941937 | A1 | 9/1999 |

(Continued)

*Primary Examiner*—Katherine Mitchell
*Assistant Examiner*—Ruth C. Rodriguez
(74) *Attorney, Agent, or Firm*—John V. Daniluck; Bingham McHale LLP

(57) ABSTRACT

A flexible reclosable container including profiles which are locked and unlocked by a slider. One embodiment of the slider has a pair of feet which extend from one end of the slider to the other end and which resist pulling of the slider off of the profiles. Another embodiment of the slider has three spaced pairs of feet which resist removal of the slider from the profiles. The slider in one embodiment has an enlarged central portion which facilitates grasping the slider and is easy to manufacture by die casting.

14 Claims, 19 Drawing Sheets

U.S. PATENT DOCUMENTS 4,262,395 A 4/1981 Kosky
4,890,935 A 1/1990 Ausnit et al.
4,907,321 A 3/1990 Williams
5,007,142 A 4/1991 Herrington
5,007,143 A 4/1991 Herrington
5,010,627 A 4/1991 Herrington et al.
5,020,194 A 6/1991 Herrington et al.
5,063,644 A 11/1991 Herrington et al.
5,067,208 A 11/1991 Herrington, Jr. et al.
5,070,583 A 12/1991 Herrington
5,073,103 A 12/1991 Liao
5,088,971 A 2/1992 Herrington
5,131,121 A 7/1992 Herrington, Jr. et al.
5,161,286 A 11/1992 Herrington, Jr. et al.
5,167,608 A 12/1992 Steffens, Jr. et al.
5,192,135 A 3/1993 Woods et al.
5,211,482 A 5/1993 Tilman
5,283,932 A 2/1994 Richardson et al.
5,293,671 A 3/1994 Oda
5,301,394 A 4/1994 Richardson et al.
5,301,395 A 4/1994 Richardson et al.
5,403,094 A 4/1995 Tomic
5,405,478 A 4/1995 Richardson et al.
5,425,825 A 6/1995 Rasko et al.
5,426,830 A 6/1995 Richardson et al.
5,431,760 A 7/1995 Donovan
5,435,864 A 7/1995 Machacek et al.
5,442,837 A 8/1995 Morgan
5,442,838 A 8/1995 Richardson et al.
5,448,808 A 9/1995 Gross
5,456,928 A 10/1995 Hustad et al.
5,482,375 A 1/1996 Richardson et al.
5,492,411 A 2/1996 May
5,566,429 A 10/1996 Martinez et al.
5,638,586 A 6/1997 Malin et al.
5,638,587 A 6/1997 Martinez et al.
5,664,299 A 9/1997 Porchia
5,669,715 A 9/1997 Dobreski et al.
5,774,955 A 7/1998 Borchardt et al.
5,794,315 A 8/1998 Crabtree et al.
5,809,621 A 9/1998 McCree et al.
5,836,056 A 11/1998 Porchia et al.
5,867,875 A 2/1999 Beck et al.
5,871,281 A 2/1999 Stolmeier et al.
5,896,627 A 4/1999 Cappel et al.
5,956,815 A 9/1999 O'Connor
5,956,924 A 9/1999 Thieman
6,003,582 A 12/1999 Blohowiak et al.
6,047,450 A 4/2000 Machacek et al.
6,088,887 A 7/2000 Bois
6,293,701 B1 9/2001 Tomic
6,305,844 B1 10/2001 Bois
6,306,071 B1 10/2001 Tomic
6,490,769 B2 12/2002 Siegel
6,594,872 B2 7/2003 Cisek
6,611,996 B2 9/2003 Blythe
6,761,481 B1 7/2004 Bois
6,789,947 B1 9/2004 Kasai
6,836,945 B2 1/2005 Savicki
6,840,675 B2 1/2005 Knight
6,874,937 B2 4/2005 Ausnit
6,895,641 B1 * 5/2005 Savicki ..... 24/30.5 R
6,954,970 B2 10/2005 McMahon et al.
6,968,604 B2 11/2005 Crevier
6,976,787 B2 12/2005 Plourde
6,979,289 B2 12/2005 McMahon et al.
6,981,299 B2 1/2006 Savicki
2003/0077009 A1 4/2003 Schreiter
2003/0182784 A1 10/2003 Savicki

FOREIGN PATENT DOCUMENTS

EP 1247748 A1 10/2002
FR 1564039 4/1969
FR 2 780 037 12/1999
GB 2085519 4/1982
WO WO 98/48655 A1 11/1998
WO WO 00/76352 A1 12/2000
WO WO 01/34487 A 5/2001
WO WO 02/39841 A2 5/2002
WO WO 02/39841 A3 5/2002
WO WO 02/062672 A1 8/2002
WO WO 02/071882 A1 9/2002
WO WO 02/071883 A1 9/2002
WO WO 02/076258 A1 10/2002
WO WO 02/102181 A1 12/2002
WO WO 03/003868 A2 1/2003
WO WO 03/009953 A1 2/2003

* cited by examiner

SLIDERS FOR RECLOSABLE CONTAINERS

FIELD OF THE INVENTION

The present invention relates to reclosable containers, and more specifically to fastener strips and sliders for flexible, reclosable containers and claims priority to U.S. Provisional Patent Application Ser. No. 60/330,140 filed Oct. 17, 2001.

BACKGROUND OF THE INVENTION

One type of flexible reclosable container includes profiles which are locked and unlocked by a slider which is moved along the profiles. Such reclosable containers are used in form, fill and seal applications where a product is prepacked and sold in the container as well as in applications where the container is sold to the consumer for use by the consumer in packaging the items desired to be packaged by the consumer. Whatever the application or use of the container, it is desirable that the slider and profiles be constructed in such a manner as to prevent the slider from easily being removed from the profiles. It is also desirable that the slider be inexpensive and easy to manufacture.

SUMMARY OF THE INVENTION

One embodiment of the slider of the present invention for locking and unlocking the fastener profiles of a flexible reclosable container might include a body including a top and a pair of sidewalls, the body having an interior bounded by the top and sidewalls. The body further includes a first pair of feet, a second pair of feet and a third pair of feet, all of said pairs of feet being for retaining the slider on the fastener profiles and guiding the slider along the profiles. The second pair of feet is positioned between and spaced from the first and third pair of feet.

Another embodiment of the present invention includes a pair of fastener strips each having a side wall with an upper portion. The fastener strips include a pair of opposing interlockable profile elements which project from the sidewalls of the fastener strips and are configured for repeated locking and unlocking of the fastener strips. Each fastener strip has a flange extending from a location proximate the upper portion of the respective fastener strip. There is also included a slider having a top and pair of opposing sidewalls and a separator for unlocking the profile elements. The top has opposing sides and a central portion therebetween. The sidewalls depend downwardly from the two opposing sides of the top. A separator depends downwardly from the central portion of the top and has a first portion with a first width configured for unlocking the profile elements. The separator also has a second portion attaching the first portion to the top, said second portion having a second width which is less than the first width. The flanges are adjacent one another when the profile elements are interlocked but the flanges are also slidable between the top and the first portion and past the attachment portion when the separator unlocks the profile elements.

Still another embodiment of the invention is a slider for locking and unlocking the fastener profiles of a flexible reclosable container which includes a body having a top and a pair of sidewalls. The body has an interior bounded by the top and the sidewalls and has a first dimension in the same direction as the profiles. The body further includes a pair of feet retaining the slider on the fastener profiles and guiding the slider along the fastener profiles. The body further includes a separator for unlocking the profile elements with the separator being mounted on the top, extending into the interior and extending the entire first dimension of said body.

Still another embodiment of the invention is a slider for locking and unlocking the fastener profiles of a flexible reclosable container. The slider includes a body having a top and a pair of sidewalls, the body having an interior bounded by the top and sidewalls and also having an opening end and a closing end. The body further includes a pair of feet retaining the slider on the fastener profiles and guiding the slider along the fastener profiles. The pair of feet extend from the opening end of the body to the closing end. The body further includes a separator depending downwardly from the top and a pair of closing bars projecting inwardly from the sidewalls with the closing bars being spaced downwardly from the separator.

Still a further embodiment of the invention is a slider for locking and unlocking the fastener profiles of a flexible reclosable container. The slider has an opening end and a closing end. The body includes a top transverse section and a pair of sidewalls connected by the transverse section at the closing end. The transverse section has an inner vertical wall. The sidewalls each have a channel extending from the vertical wall of said transverse section to said opening end. There is also provided closing bars mounted on the sidewalls at the closing end and extending inwardly of the slider. The slider further includes a top portion slidingly received within the channels said top portion having a separator mounted thereon and extending between the sidewalls for unlocking the fastener profiles.

Still a further embodiment of the invention involves a slider for locking and unlocking the fastener profiles of a flexible reclosable container. The slider includes a body including a top and a pair of sidewalls. The body has an interior bounded by the top and the sidewalls and also has an opening end and a closing end. The body further includes a pair of feet retaining the slider on the fastener profiles and guiding the slider along the fastener profiles. The body further includes a separator depending downwardly from the top and a pair of closing bars projecting inwardly from the sidewalls. The closing bars are spaced downwardly from the separator and upwardly from the feet.

Still another embodiment of the invention is a slider for locking and unlocking the fastener profiles of a flexible reclosable container. The slider includes a body including a top and a pair of sidewalls with the body having an interior bounded by the top and sidewalls and also having an opening end and a closing end. The body further includes a pair of feet for retaining the slider on the fastener profiles and guiding the slider along the fastener profiles. The pair of feet extend from the opening end of the body to the closing end. The body further includes a separator depending downwardly from the top and a pair of closing bars projecting inwardly from the sidewalls with the closing bars being spaced downwardly from the separator and upwardly from the feet.

DESCRIPTION OF THE DRAWINGS

Other objects and advantages of the invention will become apparent upon reading the following detailed description upon reference to the drawings in which.

DESCRIPTION OF THE PREFERRED EMBODIMENT

Figure 1A:
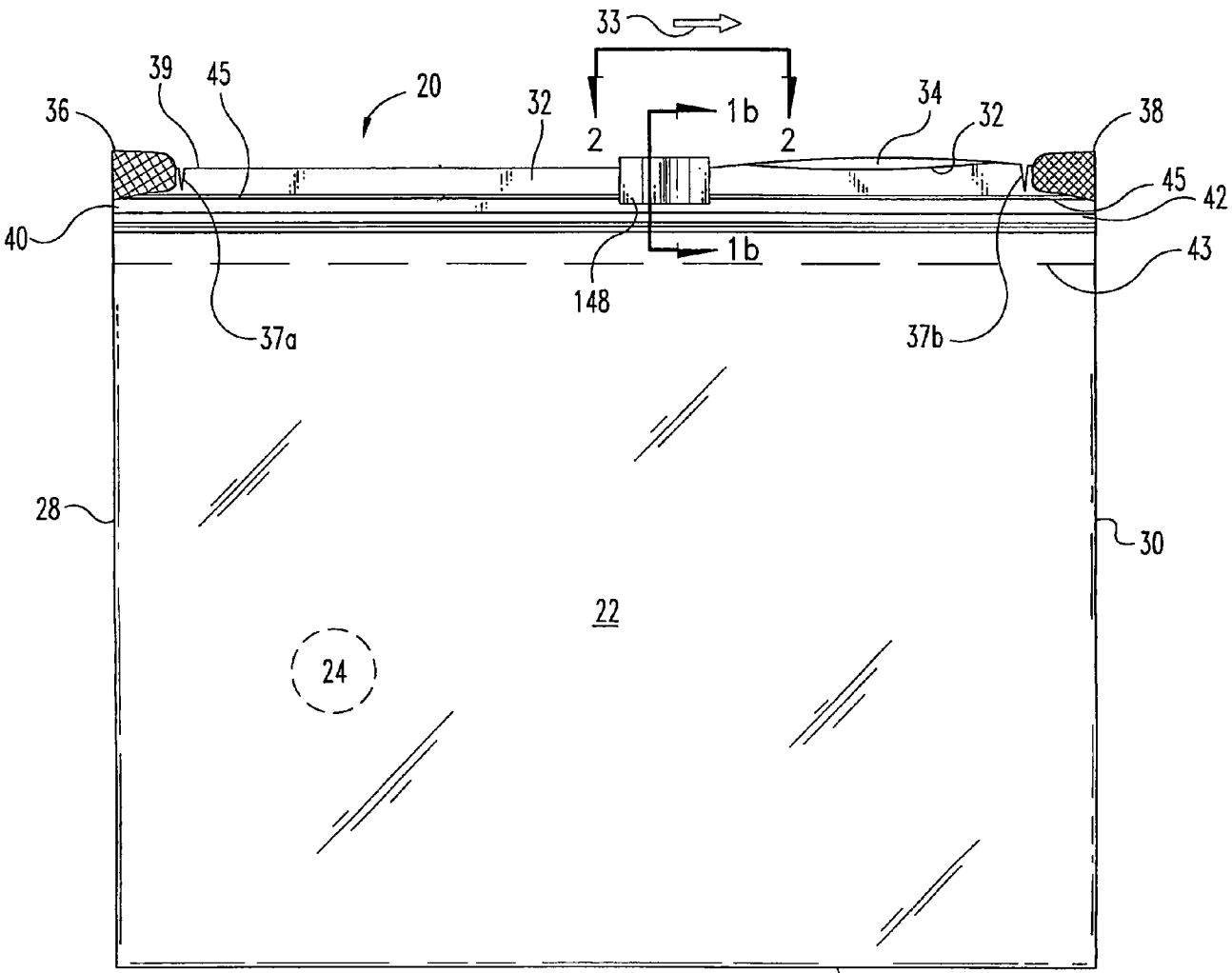
FIG. 1A is a side plan view of a flexible, reclosable container according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

FIG. 1A shows a flexible recloseable container 20 for containing a product, container 20 being useful for being formed, filled, and sealed with goods, and also being useful when sold as an empty container. Container 20 comprises first and second sidewalls 22 and 24, respectively, which may be made from any suitable thermoplastic film such as, for example, low density polyethylene, linear low density polyethylene, or similar materials. Sidewalls 22 and 24 include first left transverse side seal 28 and second right transverse side seal 30. Container 20 also includes a bottom edge 26 generally opposite a pair of interlocking fastener strips 32 and 34. Bottom edge 26 may include a fold between sidewalls 22 and 24, such as for a container formed using vertical form, fill and seal apparatus, or alternatively edge 26 may include a seal between sidewalls 22 and 24, such as for a container 20 formed using a horizontal form, fill, and seal apparatus.

Interlocking strips 32 and 34 of fastener profiles run along the top edge of container 20. Strips 32 and 34 are sealed together at endstops 36 and 38. A formed docking station 39 is located near endstop 36. As an alternative to a formed docking station, strips 32 and 34 can also incorporate one or more vertical slits 37*a* and/or 37*b*, as will be described later. Strips 32 and 34 are sealed to each other and also to sidewalls 22 and 24 at corner seals 40 and 42. Comer seals 40 and 42 are located along their respective edges of container 20. Seals 40 and 42 are generally located below shoulders 45 and 47 of fastener strips 32 and 34, respectively.

In one embodiment of the present invention, container 20 includes a tamper-evident seal 43 between sidewalls 22 and 24. Seal 43 may be an extension of the interlocking strips that extend internally across the opening of container 20. Seal 43 may be integrally molded with the strips, or may be attached separately. The broken or unbroken state of seal 43 provides evidence to the user of whether or not container 20 has been previously opened. A tamper evident seal is especially useful with a form, fill, and seal machine that inserts an edible product into container 20.

Figure 1B:
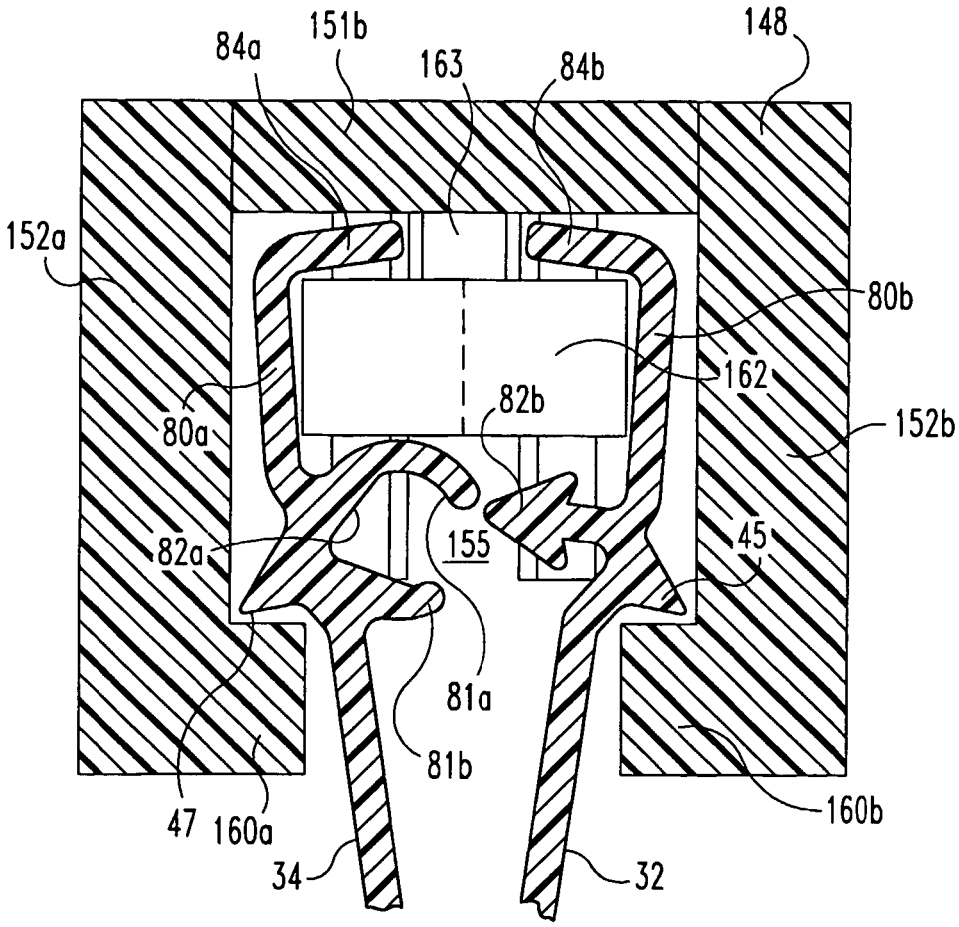
FIG. 1B is a cross-sectional view of the apparatus of FIG. 1A as taken in the direction of the arrows along line 1B-1B of FIG. 1A.

Referring to FIGS. 1A and 1B, slider 148 is slidable upon fastener strips 32 and 34. Fastener strips 32 and 34 include a pair of vertical walls 80*b* and 80*a*, respectively. A male profile element 82*b* projects outwardly from wall 80*b*. A female profile element 82*a* projects outwardly from wall 80*a*. Slider 148 is shown enclosing non-interlocked portions of fastener strips 34 and 32. Movement of slider 148 along the fastener strips results in either an interlocking of profiles 82*a* and 82*b*, or an unlocking of profiles 82*a* and 82*b*. Female profile 82A includes an upper member 81*a* which projects outwardly from strip wall 82*a* to a greater extent than lower member 81*b*. Because of the greater length of upper member 81*a* over 81*b*, during interlocking of strips 32 and 34 male profile element 82*b* comes into contact first with upper member 81*a*, and second with lower member 81*b*. In one embodiment of the present invention slider 148 includes a separator 162 having a vertical depth from central portion 151*b* sufficient to separate elements 82*a* and 82*b* as slider 148 is moved along the fastener strips in an opening direction. Feet 160*b* and 160*a* of slider 148 retain the slider on the interlocking strips by shoulders 45 and 47, respectively.

In another embodiment of the present invention, container 20 contains one or more vertical slits 37*a* and 37*b* that extend downward through fastener strips 32 and 34 through the top portion of the fastener strips, but preferably not through the interlocking profile elements of the fastener strips. These slits 37*a* and 37*b* reduce the stresses imposed upon the fastener strips due to the presence of the slider separator when the slider is proximate to one of the endstops. For example, slit 37*b* of bag 20 increases the flexibility of the top portion of the fastener strips such that there is reduced separation force on the interlocked profile elements near endstop 38 when the slider and separator are docked adjacent to endstop 38. It should be understood; however, that not all embodiments of the invention include vertical slits 37*a* and 37*b*. For example, in one embodiment of the invention, a docking station 39 is formed by pressing the slider against a heated still-formable endstop 36. In such an embodiment the slits 37*a* and 37*b* are not necessary and not present.

Figure 2:
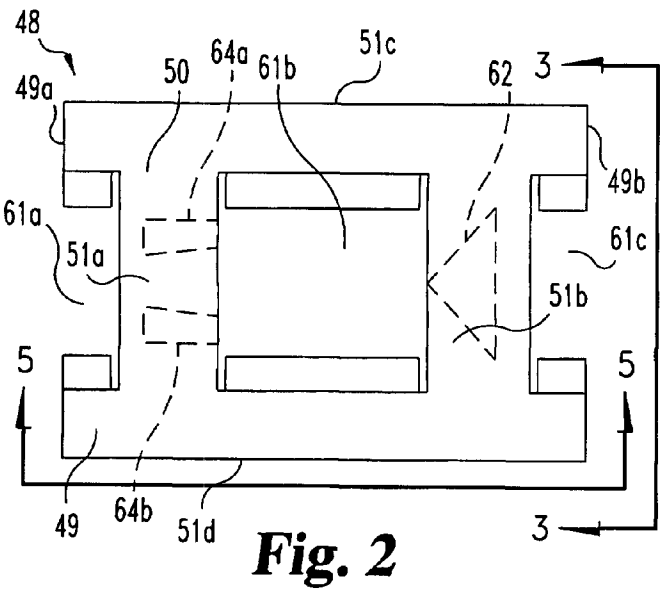
FIG. 2 is a top plan view of a slider of according to one embodiment of the present invention.

FIGS. 2, 3, 4, and 5 present top, end, bottom, and side elevational views of a slider 48 according to one embodiment of the present invention. Slider 48 includes a body 49 which is preferably injection molded from a plastic material. In one embodiment, slider 48 slidingly engages a pair of interlockable fastener strips of a flexible, reclosable container, similar to that shown in FIGS. 1A and 1B. As best seen in FIG. 2, body 49 includes a closing end 49*a*, through which passes a pair of interlocked fastener strips as slider 48 is moved in a closing direction along the fastener strips. Body 49 further includes an opening end 49*b*, through which passes the unlocked pair of fastener profile strips as slider 48 is moved in a closing direction along the strips.

Referring again to FIGS. 2-5, body 49 also includes a top 50 having a pair of central portions 51*a* and 51*b* which transversely span from one top edge 51*c* to an opposing top edge 51*d*. A pair of opposing sidewalls 52*a* and 52*b* depend downward from edges 51*c* and 51*d*, respectively, of top 50. Sidewalls 52*a* and 52*b* each include a bottom edge 54*a* and 54*b*, respectively, which are generally vertically opposite of top edges 51*c* and 51*d*, respectively.

Figure 4:
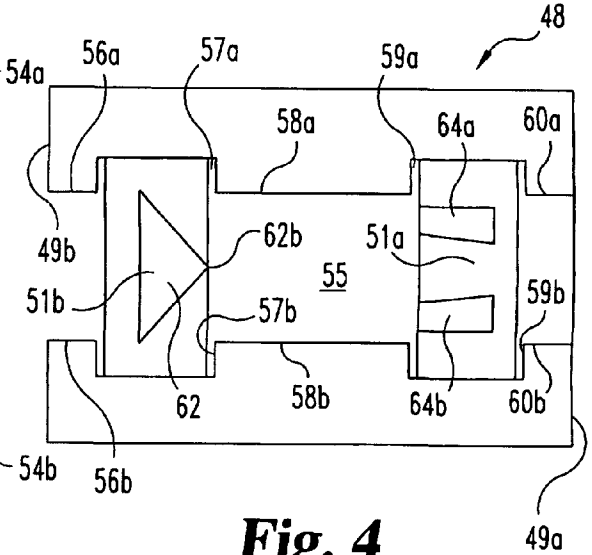
FIG. 4 is a bottom plan view of the apparatus of FIG. 2 as taken in the direction of the arrows along line 4-4 of FIG. 3.
Figure 3:
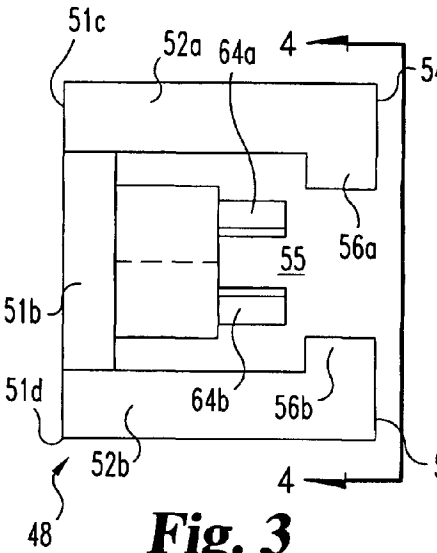
FIG. 3 is an end elevational view of the apparatus of FIG. 2 as taken in the direction of the arrows along line 3-3 of FIG. 2.
Figure 5:
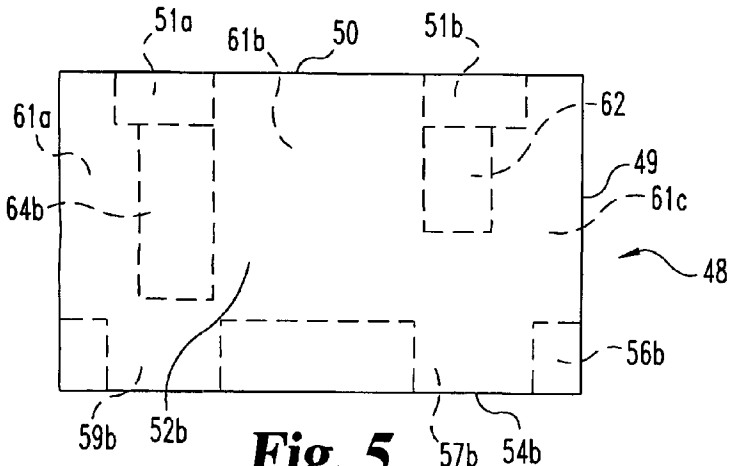
FIG. 5 is a side elevational view of the apparatus of FIG. 2 as taken along line 5-5 of FIG.2.
Figure 8:
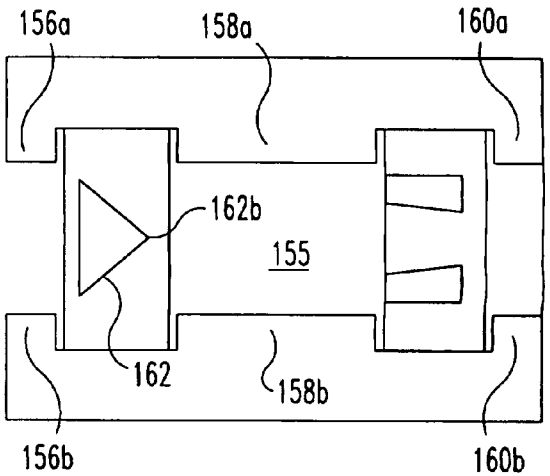
FIG. 8 is a bottom plan view of the apparatus of FIG. 6 as taken in the direction of the arrows along line 8-8 of FIG. 7.
Figure 7:
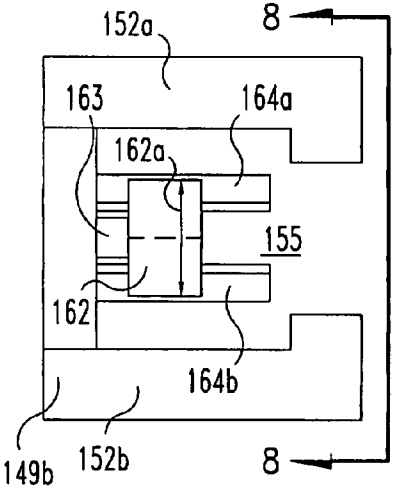
FIG. 7 is an end elevational view of the apparatus of FIG. 6 as taken in the direction of the arrows along line 7-7 of FIG. 6.
Figure 6:
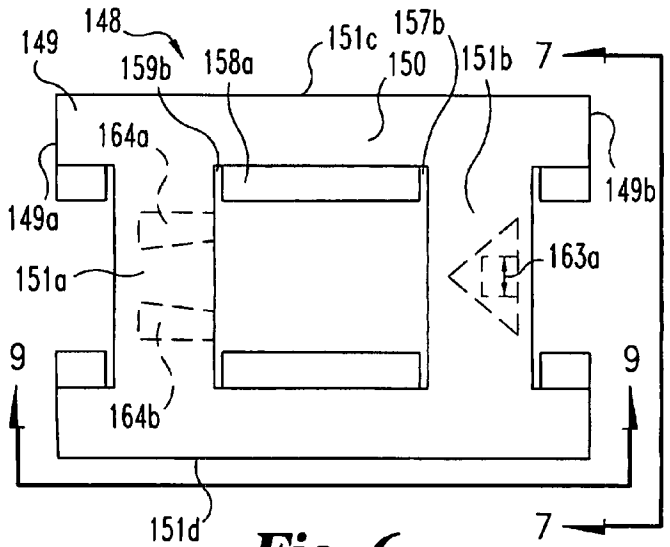
FIG. 6 is a top plan view of a slider according to another embodiment of the present invention.

Top 50 and sidewalls 52*a* and 52*b* bound an interior 55 of slider 48. Projecting from each sidewall toward interior 55 are one or more feet. As best seen in FIG. 4, projecting inwardly from sidewall 52*a* are feet 56*a*, 58*a*, and 60*a*. Projecting inwardly from sidewall 52*b* are feet 56*b*, 58*b*, and 60*b*. Preferably, feet 56*a* and 56*b* are aligned facing each other along the length of slider 48. Further, feet 58*a* and 58*b* are aligned facing each other, and feet 60*a* and 60*b* are aligned facing each other. Preferably, slider 48 includes three pair of feet, with adjacent pairs of feet being spaced apart by a gap. Referring to FIGS. 4 and 5, feet 56*a* and 58*a* are spaced apart by a gap 57*a*, and feet 58*a* and 60*a* are spaced apart by a gap 59*a*. Further, feet 56*b* and 58*b* are spaced apart by gap 57*b*, and feet 58*b* and 60*b* are spaced apart by gap 59*b*. Feet 56*a* and 56*b* are located proximate opening end 49*b*; feet 60*a* and 60*b* are located proximate closing end 49*a*.

The pairs of feet of the slider co-act with shoulders of the fastener strips to maintain the slider engaged with the fastener strips, and further to assist in guiding the sliding motion of the slider along fastener strips. As best seen in FIG. 1B, shoulders 45 and 47 are located within the corners formed by the union of foot 160*b* and sidewall 152*b* and foot 160*a* and sidewall 152*a*, respectively. Any attempt to vertically lift slider 148 from strips 32 and 34 is resisted by interference of shoulders 45 and 47 with feet 160*b* and 160*a*, respectively.

However, the integrity of shoulders 45 and 47 is sometimes compromised by other features of container 20. Referring to FIG. 1*a*, the placement of fused endstops 36 and 38 at opposite ends of fastener strips 32 and 34 can distort or eliminate the edgemost portions of shoulders 45 and 47. This distortion can reduce the co-action of the shoulders and feet that keeps the slider engaged to the bag. For example, moving the slider as far as possible toward endstop 38 can result in disengagement of the endmost feet from the shoulders. On a slider having only two pairs of opposing feet, the disengagement of one pair of feet from the shoulder permits the user to inadvertently rotate the slider about the remaining pair of engaged feet, and subsequently lift the slider from the fastener strips. However, a slider according to one embodiment of the present invention includes a central pair of feet such as feet 58*a* and 58*b*. Even if feet 60*a* and 60*b* become disengaged from shoulders of the fastener strips, the central feet 58*a* and 58*b* and opening end feet 56*a* and 56*b* remain engaged with the shoulders, discouraging or preventing rotation of the slider and its subsequent pull-off from the fastener strips.

The placement of gaps between adjacent pairs of feet permits some embodiments of the present invention to reduce the material cost and weight of the slider, in comparison to those sliders which include a continuous foot along the length of the sidewalls from the opening end to the closing end. In addition, as best seen in FIGS. 2 and 5, the placement of the gaps can also facilitate design and fabrication of the injection molding dies and also facilitate the injection molding process. For example, gap 59*b* is located below central portion 51*a* and closing bars 64*a* and 64*b*. Gap 57*b* is located below central portion 51*b* and separator 62. In some embodiments, slider 48 is injection molded in a two-part die, with the two die parts coming together in the vertical direction (vertical with reference to FIG. 5). In addition, central portions 51*a* and 51*b* of top 50 are spaced apart by a gap 61*b*. Central portion 51*a* is spaced apart from edge 49*a* of body 49 by a gap 61*a*. Central portion 51*b* is spaced apart from edge 49*b* of body 49 by gap 61*c*. As best seen in FIG. 5, gaps 61*a*, 61*b*, and 61*c* are arranged in alternating sequence with gaps 59*b* and 57*b*. Thus, a die half for injection molding of slider 48 extending downward (as viewed on FIG. 5) includes solid portions which correspond to gaps 61*a*, 61*b*, and 61*c*. The die half for injection molding of slider 48 which extends vertically upward (to join with the top die half) includes solid portions generally within gaps 57*b* and 59*b*.

Referring again to FIGS. 2, 3, 4, and 5, slider 48 includes a triangular- or wedge-shaped separator 62 which extends from central portion 51*b* downward into interior 55. Separator 62 includes a narrow portion 62*b* which begins spreading apart interlocked profiles when the slider is moved along the fastener strips toward the separator. A pair of closing bars 64*a* and 64*b* project downward from central portion 51*a*. Closing bars 64*a* and 64*b* are adapted and configured to interlock fastener strips sliding between the closing bars.

FIGS. 6, 7, 8, and 9 depict top, end, bottom, and side elevational views of a slider according to another embodiment of the present invention. The use of an "N" 100 series prefix (NXX) with an element number (XX) refers to an element that is the same as the non-prefixed element (XX) previously described or depicted, except for the differences which are described or depicted hereafter.

Figure 9:
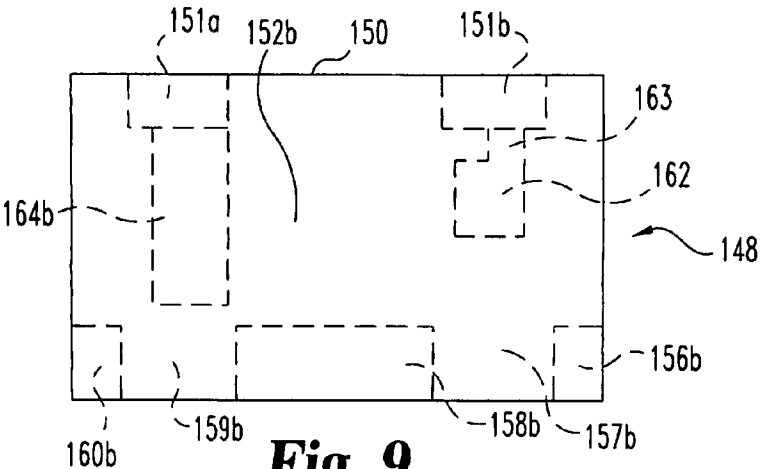
FIG. 9 is a side elevational view of the apparatus of FIG. 6 as taken in the direction of the arrows along line 9-9 of FIG. 6.

Slider 148 is substantially the same as slider 48, with one difference being the manner of coupling the separator to a central portion of the top. Referring to FIG. 9, a triangular- or wedge-shaped separator 162 is attached to central portion 151*b* of top 150 by an intermediate attachment portion 163. This attachment portion has a width 163*a* perpendicular to the longitudinal axis of slider 148 that is less than a separating width 162*a* of separator 162. Attachment portion 163 is depicted with a square cross section, but can have a cross section of any shape. Preferably, attachment portion 163 is integrally molded with separator 162 and central portion 151*b*.

This incorporation of a reduced width attachment portion above the separator assists in maintaining slider 148 in engagement with a pair of fastener strips. Referring to FIG. 1B, slider 148 is shown engaged with a pair of fastener strips 32 and 34. Each fastener strip includes a top flange 84*a* and 84*b* which projects inwardly from sidewalls 80*a* and 80*b*, respectively, of fastener strips 34 and 32, respectively. Flanges 84*a* and 84*b* provide a top closure of the fastener strips when the fastener strips are interlocked. Further, top flanges 84*a* and 84*b* are captured within interior 155 between the top surface of separator 162 and the bottom surface of central portion 151*b*. Flanges 84*a* and 84*b* extend inwardly from their respective sidewalls toward the interior such that a flange and sidewall wrap around separator 162. The use of a reduced width section 163 accommodates the flanges by providing sufficient lateral space for their sliding movement through the slider. Further, any attempt to pull slider 148 off of bag 120 results in interference between the top corners of separator 163 and the inside surfaces of the flanges, thus increasing the strength of the attachment of the slider 148 to strips 32 and 34.

FIGS. 10, 11, 12, and 13 present top, end, bottom, and side elevational views of a slider 248 according to one embodiment of the present invention. Slider 248 includes a body 249 which is preferably injection molded from a plastic material. In one embodiment, slider 248 slidingly engages a pair of interlockable fastener strips of a flexible, reclosable container, similar to that shown in FIGS. 1A and 1B. Body 249 includes a closing end 249*a*, through which passes a pair of interlocked fastener strips as slider 248 is moved in a closing direction along the fastener strips. Body 249 further includes an opening end 249*b*, through which passes the unlocked pair of fastener profile strips as slider 248 is moved in a opening direction along the strips.

Referring again to FIGS. 10-13, body 249 also includes a top 250 having a central portion which transversely spans from one top edge 251*c* to an opposing top edge 251*d*. A pair of opposing sidewalls 252*a* and 252*b* depend downward from edges 251*c* and 251*d*, respectively, of top 250. Sidewalls 252*a* and 252*b* each include a bottom edge 254*a* and 254*b*, respectively, which are generally vertically opposite of top edges 251*c* and 251*d*, respectively.

Figure 11:
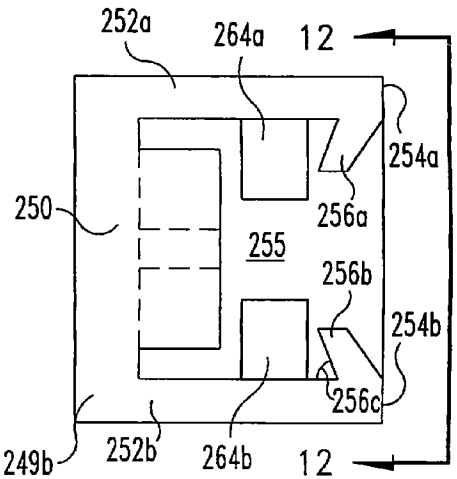
FIG. 11 is an end elevational view of the apparatus of FIG. 10 as taken in the direction of the arrows along line 11-11 of FIG. 10.
Figure 12:
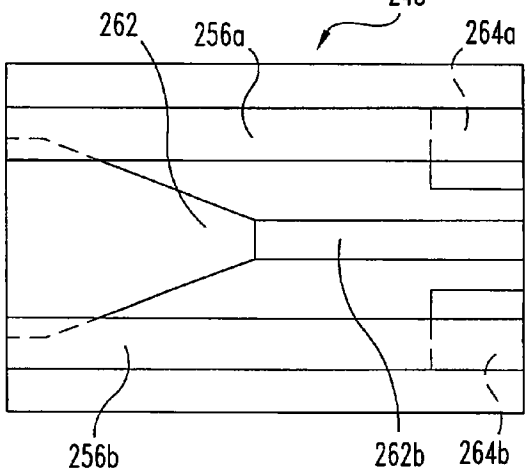
FIG. 12 is a bottom plan view of the apparatus of FIG. 10 as taken in the direction of the arrows along line 12-12 of FIG. 11.
Figure 10:
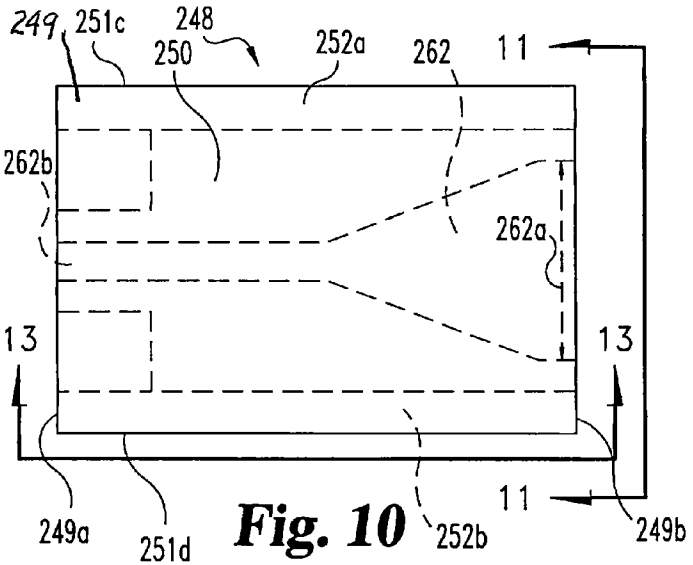
FIG. 10 is a top plan view of a slider of according to another embodiment of the present invention.

Top 250 and sidewalls 252*a* and 252*b* bound an interior 255 of slider 248. Projecting from each sidewall toward interior 255 are a pair of opposing feet. As best seen in FIGS. 11 and 12, projecting inwardly from sidewall 252*a* is foot 256*a*, and projecting inwardly from sidewall 252*b* is foot 256*b*. Preferably, feet 256*a* and 256*b* are aligned facing each other along the length of slider 248.

The pair of feet of the slider co-act with shoulders of the fastener strips to maintain the slider engaged with the fastener strips, and further to assist in guiding the sliding motion of the slider along fastener strips. Referring to FIG. 1B, shoulders 45 and 47 are located within the corners formed by the union of foot 256*b* and sidewall 252*b* and foot 256*a* and sidewall 252*a*, respectively. Any attempt to vertically lift slider 248 from strips 232 and 234 is resisted by interference of shoulders 45 and 47 with feet 256*b* and 256*a*, respectively.

Slider 248 incorporates various improvements which reduce the possibility a user will inadvertently pull slider 248 off of a pair of fastener strips. As best seen in FIG. 11, each foot 256*a* and 256*b* is inclined upward toward top 250, forming an angle 256*c* between the upper surface of the foot and the inner surface of the corresponding sidewall that is less than 90 degrees. In a more preferred embodiment, angle 256*c* is less than about 75 degrees and more than about 20 degrees. Further, although FIG. 11 depicts an angled foot with substantially linear surfaces, the present invention also contemplates the use of a hook-shaped cross section, including radiused or rounded portions.

Separator 262 of slider 248 includes a nose section 262*b* which extends from the triangular- or wedge-shaped portion of separator 262 having a width 262*a* to the face of the closing end 249*a*. A nose 262*b* that extends flush to the face of closing end 249*a* limits the maximum travel of slider 248. For example, as best considered in reference to FIG. 1A, movement of a slider 248 toward endstop 36 results in contact of nose 262*b* with the innermost fused area of endstop 36. This contact limits the sliding travel of slider 248, making it more difficult for a user to slide slider 248 such that a portion of the feet are no longer in contact with the fastener strip shoulder, and thus more difficult to pull slider 248 out of engagement with fastener strips 32 and 34.

Figure 13:
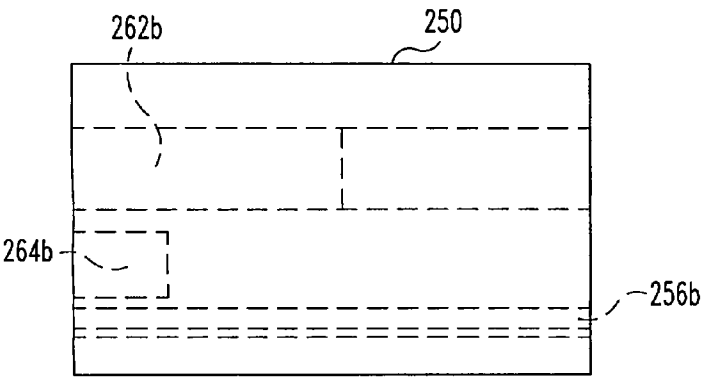
FIG. 13 is a side elevational view of the apparatus of FIG. 10 as taken in the direction of the arrows along line 13-13 of FIG. 10.
Figure 16:
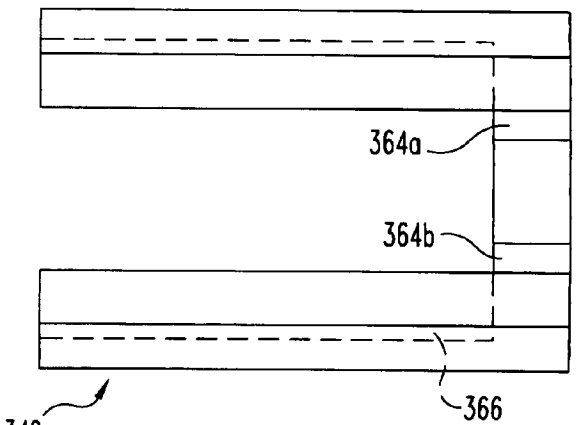
FIG. 16 is a bottom plan view of the apparatus of FIG. 14 as taken in the direction of the arrows along line 16-16 of FIG. 15.
Figure 15:
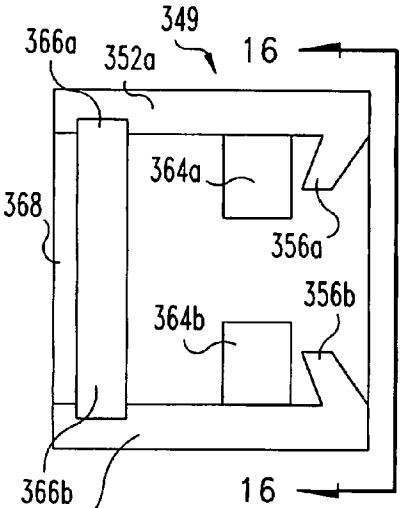
FIG. 15 is an end elevational view of the apparatus of FIG. 14 as taken in the direction of the arrows along line 15-15 of FIG. 14.
Figure 14:
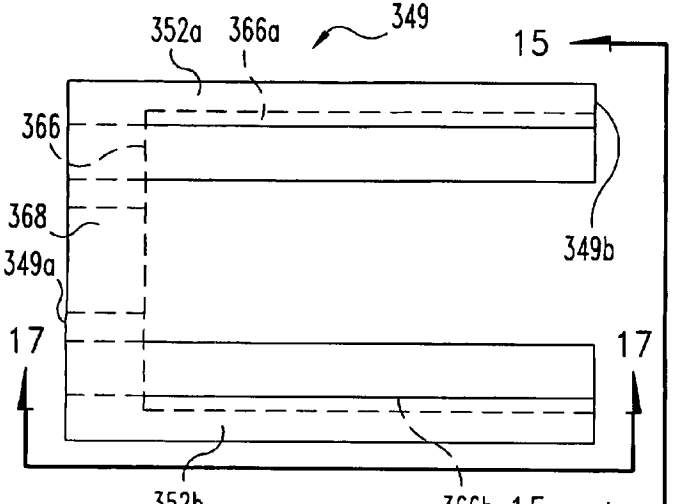
FIG. 14 is a top plan view of a slider body of according to another embodiment of the present invention.
Figure 17:
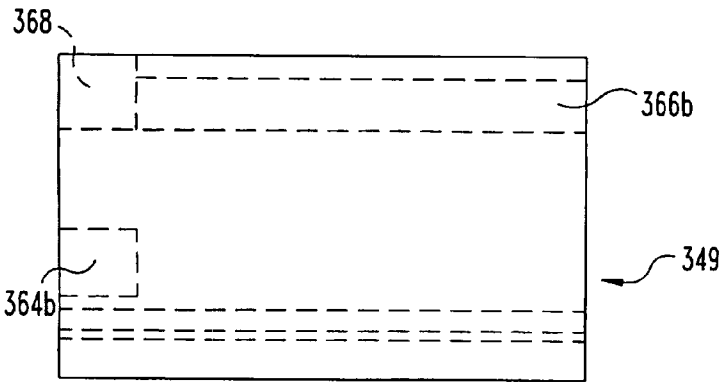
FIG. 17 is a side elevational view of the apparatus of FIG. 14 as taken in the direction of the arrows along line 17-17 of FIG. 14.
Figure 20:
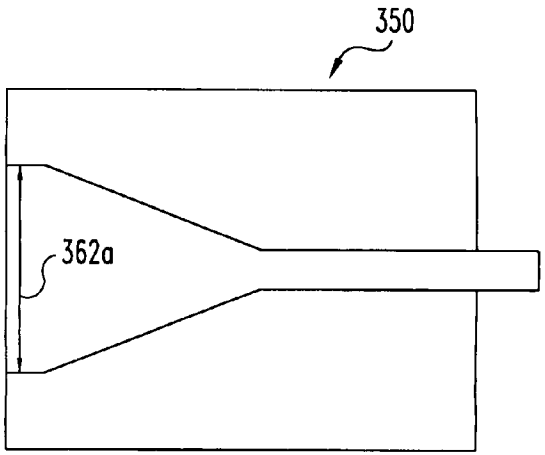
FIG. 20 is a bottom plan view of the apparatus of FIG. 18 as taken in the direction of the arrows along line 20-20 of FIG. 19.
Figure 19:
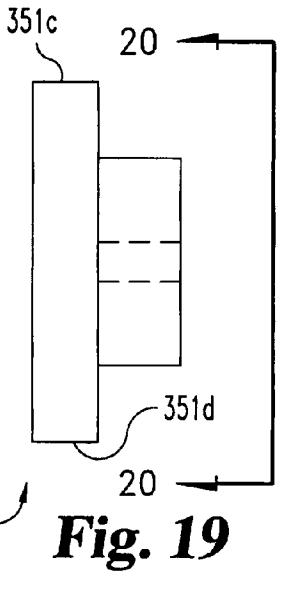
FIG. 19 is an end elevational view of the apparatus of FIG. 18 as taken in the direction of the arrows along line 19-19 of FIG. 18.
Figure 18:
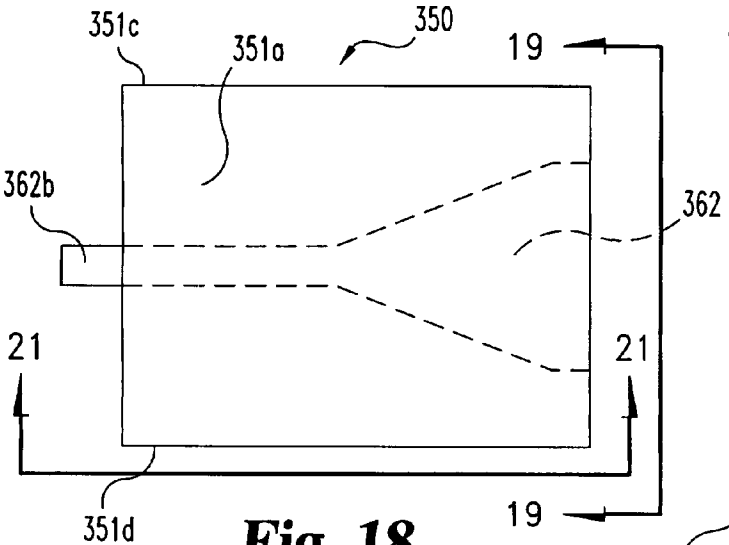
FIG. 18 is a top plan view of a removable slider top usable with the body of FIG. 14 according to one embodiment of the present invention.
Figure 21:
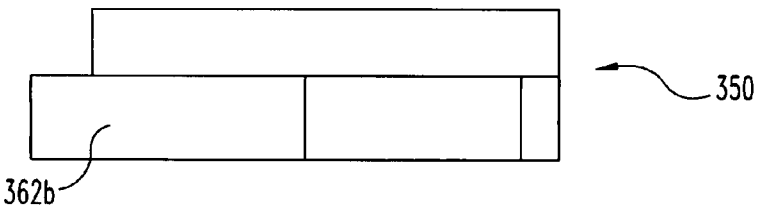
FIG. 21 is a side elevational view of the apparatus of FIG. 18 as taken in the direction of the arrows along line 21-21 of FIG. 18.

As best seen in FIGS. 11 and 13, closing bars 264*a* and 264*b* project inwardly from sidewalls 252*a* and 252*b* toward interior 255. Preferably, closing bars 264*a* and 264*b* are located vertically between the bottom surface of separator 262 and the top surface of feet 256*a* and 256*b*. This manner of vertical location facilitates the use of a dieset for injection molding that couples together along the longitudinal axis of the slider, with reference to FIG. 13 (i.e., a dieset that couples together in a direction parallel to the length of the fastener strips).

As can be best seen in FIGS. 11 and 13, slider 248 includes features with different vertical orientations to facilitate injection molding by a pair of dies that couple together in a longitudinal direction (i.e. the dies come together such that one die approaches from opening side 249*b* toward another die that approaches from closing side 249*a*). In this manner, it is possible to mold certain features, such as the angled interior corner represented by angle 256*c*, that are difficult to fabricate with dies that approach each other vertically. This difficulty arises because of the vertical alignment of closing bars 264*a* and 264*b* directly above the angled interior surfaces of feet 256*a* and 256*b*, respectively. In contrast, in one embodiment of the present invention the dies approach each other longitudinally, and the open, interior volume beneath the bottom of the closing bars and the top of the angled feet is easily reproduced by a complementary-shaped solid portion of a longitudinally-approaching die member.

Figure 22B:
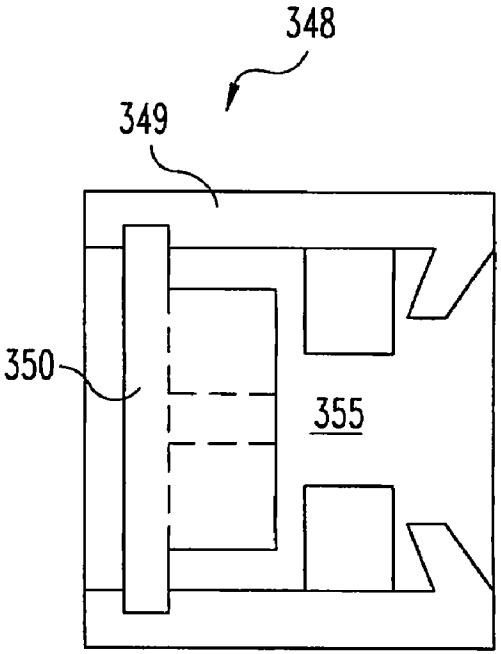
FIG. 22B is an end elevational view of the slider assembly of FIG. 22A as taken in the direction of the arrows along line 22B-22B of FIG. 22A.
Figure 22A:
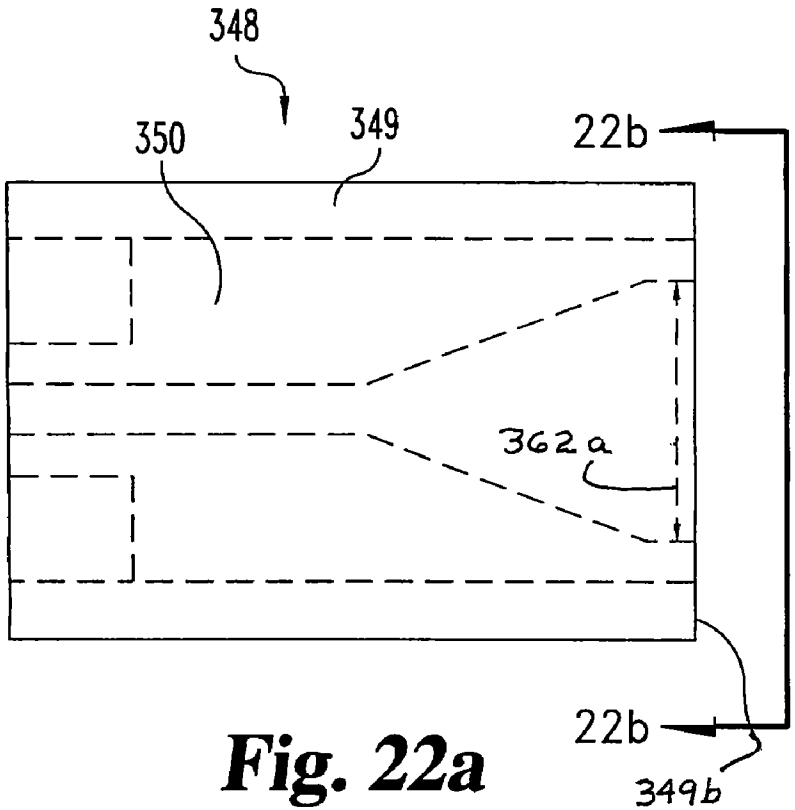
FIG. 22A is a top plan view of an assembled two piece slider according to one embodiment of the present invention.

FIGS. 14-21, 22A, and 22B depict a slider according to another embodiment of the present invention. These figures depict the two pieces of a two-part slider 348 for a reclosable container. FIGS. 14-17 show a body 349 with a pair of sidewalls 352*a* and 352*b*. FIGS. 18-21 show a separately molded top 350 which is slidingly received within a track 366 of body 349. FIGS. 22A and 22B show top and end views, respectively, of the assembled slider 348.

FIGS. 14-17 depict a body 349 which is similar to body 249 previously discussed. However, body 349 includes a top transverse section 368 which connects sidewalls 352*a* and 352*b*. Sidewalls 352*a* and 352*b* each include a channel section 366*a* and 366*b*, respectively, which extend from the face from opening end 349*b* toward an inner vertical wall of top transverse section 368. Extending inwardly from sidewalls 352*a* and 352*b* are closing bars 364*a* and 364*b* which function to interlock fastener strips sliding between the closing bars. Sidewalls 352*a* and 352*b* bound an interior 355 of slider 348. Projecting inwardly from sidewall 352*a* are feet 356*a*, and projecting inwardly from sidewall 352*b* are feet 356*b*.

FIGS. 18-21 depict a top portion 350, which includes a separator 362 having a nose portion 362*b* similar to nose portion 262*b* previously described. However, top portion 350 is adapted and configured to be slidingly received within channels 366*a* and 366*b*, resulting in a slider 348 which is substantially similar to one piece slider 248. Preferably, separable top portion 350 is received within channels 366*a* and 366*b* in light interference fit, such that friction maintains top 350 coupled to body 349. Body 349 also includes a top 350 having a central portion 351*a* which transversely extends from one top edge 351*c* to an opposing top edge 351*d*. Separator 362 has a width 362*a*.

FIGS. 22A and 22B show top and end views, respectively, of an assembled two piece slider 348. Top 350 is shown inserted in channels 366*a* and 366*b*.

Figure 24:
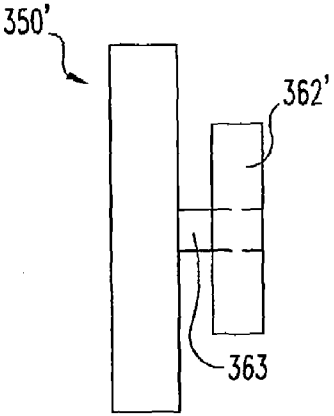
FIG. 24 is an end elevational view of the apparatus of FIG. 23.
Figure 25B:
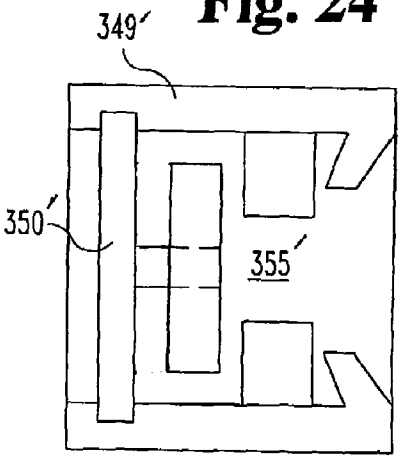
FIG. 25*b* is an end elevational view of a slider assembly.
Figure 23:
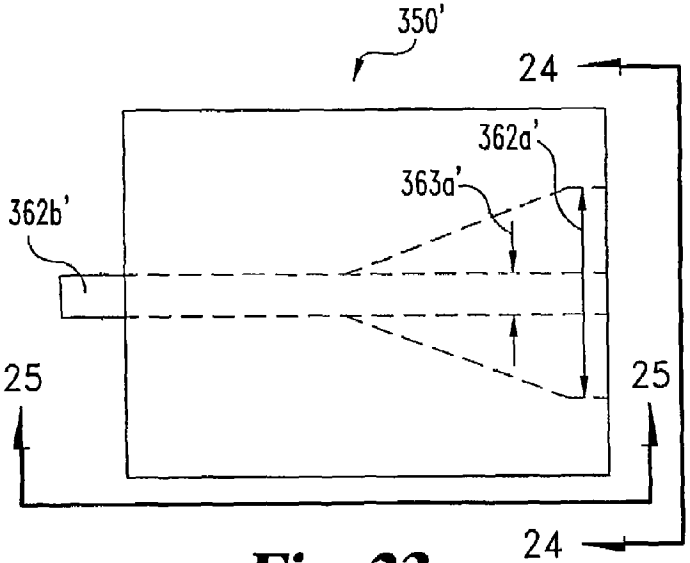
FIG. 23 is a top plan view of a removable slider top according to another embodiment of the present invention.
Figure 25A:
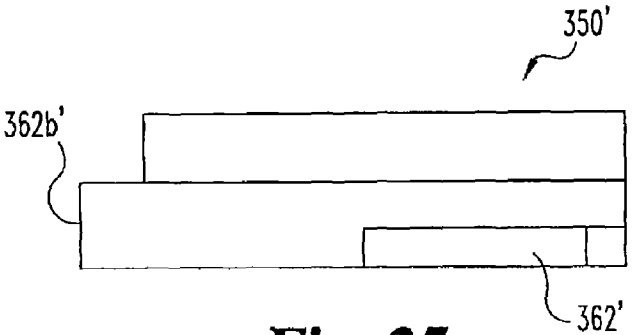
FIG. 25*a* is a side elevational view of the apparatus of FIG. 23.

FIGS. 23, 24, and 25*a* depict top, end, and side elevational views, respectively, of a separable top 350' for a slider 348'. FIG. 25*b* is an end view of an assembled slider 348'. Slider 348' includes top 350', slidingly received within channels 366*a* and 366*b* of body 349. Top 350' is the same as top 350, except that separator 362' is spaced apart from and underneath the bottom surface of slider 348' or top 350' by an attachment portion 362*a'* of wedge-shaped separator 362'.

Figure 26:
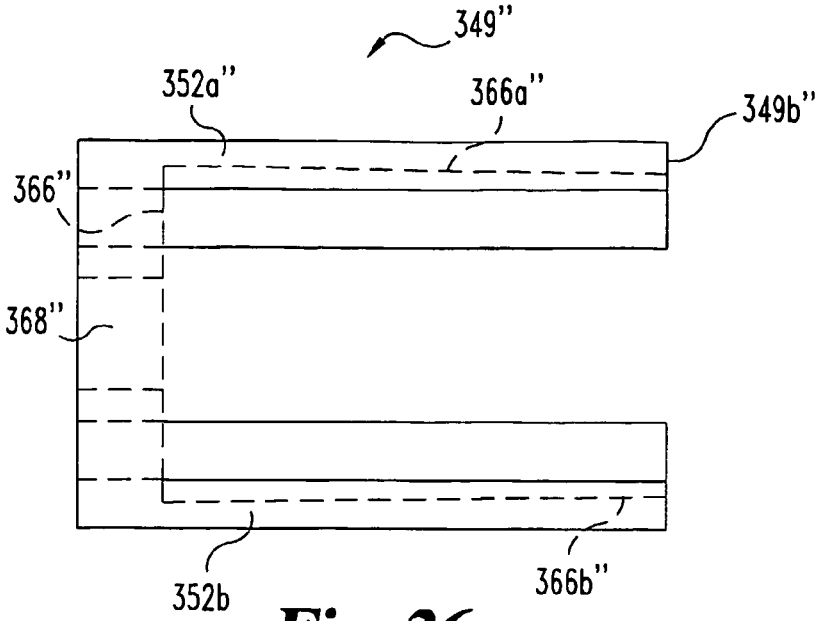
FIG. 26 is a top plan view of a slider body according to another embodiment of the present invention.
Figure 27:
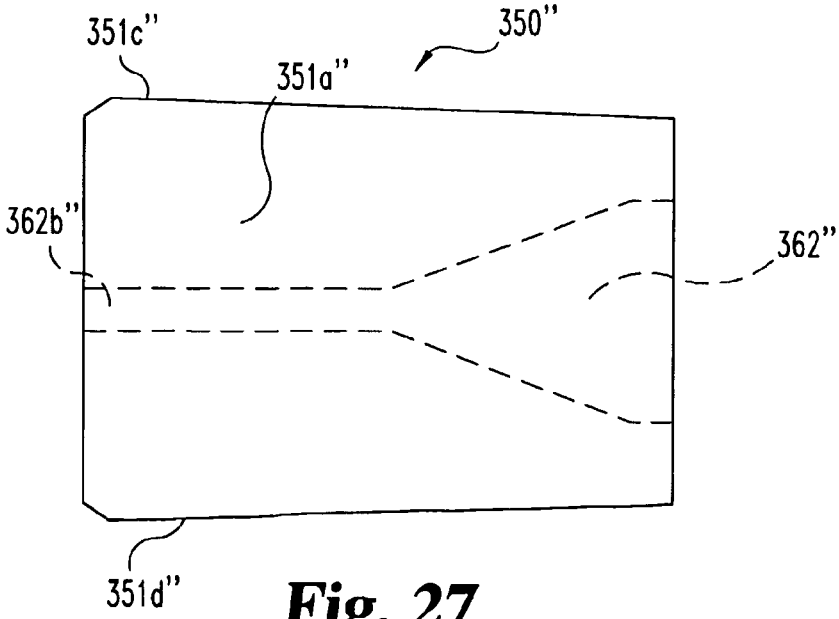
FIG. 27 is a top plan view of a removable slider top according to another embodiment of the present invention.

FIGS. 26 and 27 depict a body 349" and separable top 350: which can be assembled to form a slider. Body 349" includes a top transverse section 368" which connects sidewalls 352*a"* and 352*b"*. Body 349" is the same as body 349, except that channels 366*a"* and 366*b"* include angled interior surfaces, as best seen in FIG. 26. Channels 366*a"* and 366*b"* are closest together at a location near 349*b"*, with the distance between opposing walls of the channels increasing as the channels extend toward closing and 349*a"*. FIG. 27 depicts a top 350" which is the same as top 350, except that top 350" includes angled side surfaces 351*c"* and 351*d"* that are complementary in shape to the inner walls of channels 366*a"* and 366*b"*, respectively. As best seen in FIG. 27, the width of top 350" is narrowest toward the opening end (i.e., proximate the widest portion of separator 362"), and widest near the closing end (i.e., near the distal end of separator nose 362*b"*).

Top 350" is slidingly received within the channels of body 349". As the widest (or closing) end of top 350" is pressed into the narrowest (or opening) end of body 349", sidewalls 352*a"* and 352*b"* are spread apart. Lead-in chambers or tapers may be provided on both of the channel inlets of body 349". Alternatively the insertion edge of top 350" may have tapered corners, as shown, to assist in the insertion and spreading apart of the sidewalls. After insertion, the sidewalls 352*a"* and 352*b"* resiliently spring back to their original position, thus locking top 350" in place.

Although FIGS. 14-27 depict a separable top which is inserted into a body proximate the opening end 349*b*, the present invention further includes separable tops and receiving channels adapted and configured for insertion from opening end 349*a*. Further, although what has been shown and described is a separable top that is symmetrical about a longitudinal axis, the present invention also contemplates those separable tops in which only one side includes an angled surface or some other feature which co-acts with the respective channel to lock the positioned top in place in the body.

Figure 28:
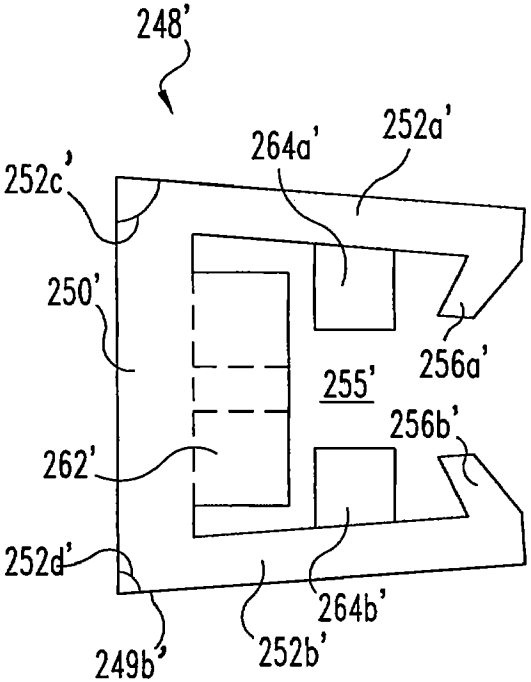
FIG. 28 is an end elevational view of a slider according to another embodiment of the present invention.
Figure 29:
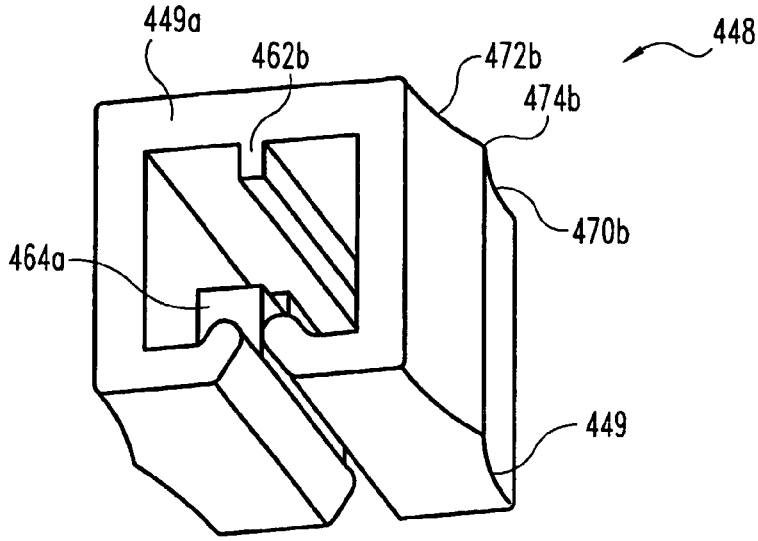
FIG. 29 is an end and bottom perspective view of a slider according to another embodiment of the present invention.
Figure 30:
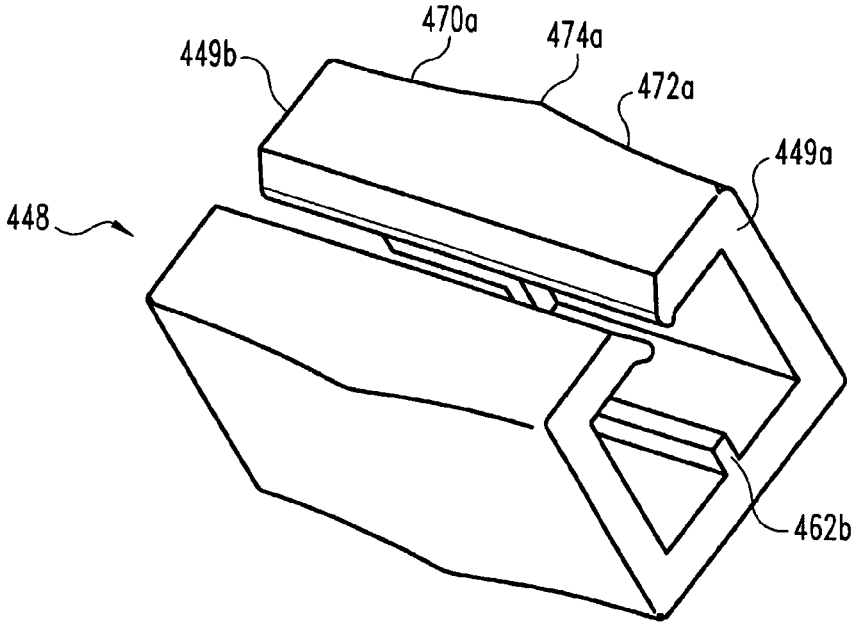
FIG. 30 is a bottom and end perspective view of the slider of FIG. 29.
Figure 31:
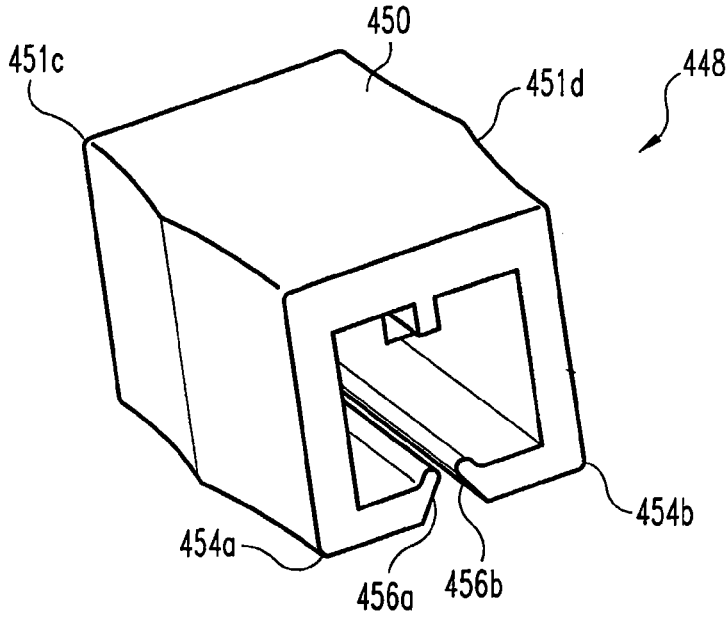
FIG. 31 is an end and top perspective view of the slider of FIG. 29.
Figure 32:
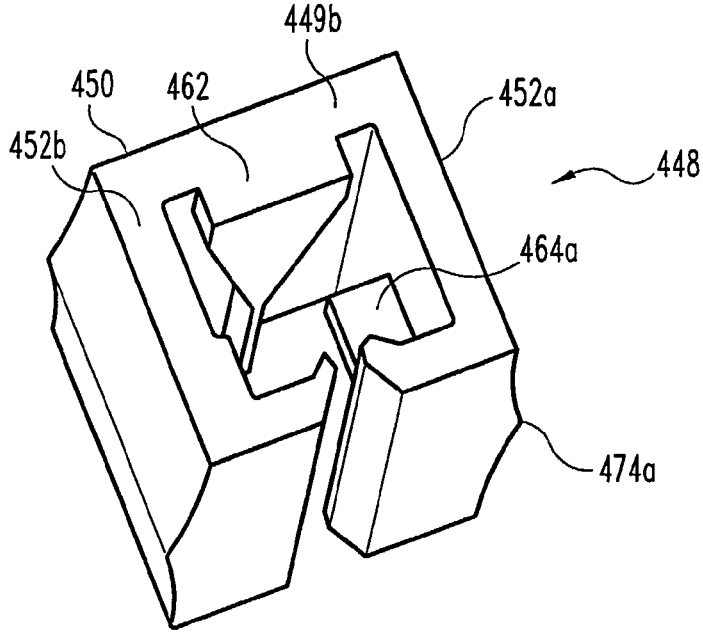
FIG. 32 is an end and bottom perspective view of the slider of FIG. 29.

FIG. 28 shows an end elevational view of a slider 248' according to another embodiment of the present invention. Slider 248' is the same as slider 248, except that the sidewalls 252*a'* and 252*b'* are angled inward toward interior 255', such that the bottom end of the sidewalls near feet 256*a'* and 256*b'* is narrower than the distance between the sidewalls toward top 250'. Slider 248' includes a separator 262'. Top 250' and sidewalls 252*a'* and 252*b'* bound an interior 255' of slider 248'. The included angle 252*c'* between top surface 250' and the exterior surface of sidewall 252*a'* is less than 90 degrees, and in a preferred embodiment is less than about 85 degrees and more than about 60 degrees. The included angle 252*d'* between top surface 250' and the exterior surface of sidewall 252*b'* is less than 90 degrees, and in a preferred embodiment is less than about 85 degrees and more than about 60 degrees. Although what has been shown and described are inwardly angled walls with substantially flat surface, the present invention also contemplates those embodiments in which the walls include rounded, non-planar surfaces.

FIGS. 29-34 present various views of a slider 448 according to one embodiment of the present invention. Slider 448 includes a body 449 which is preferably injection molded from a plastic material. In one embodiment, slider 448 slidingly engages a pair of interlockable fastener strips of a flexible, reclosable container, similar to that shown in FIGS. 1A and 1B. Body 449 includes a closing end 449*a*, through which passes a pair of interlocked fastener strips as slider 448 is moved in a closing direction along the fastener strips. Body 449 further includes an opening end 449*b*, through which passes the unlocked pair of fastener profile strips as slider 448 is moved in a opening direction along the strips.

Referring again to FIGS. 29-34, body 449 also includes a top 450 having a central portion which transversely spans from one top edge 451*c* to an opposing top edge 451*d*. A pair of opposing sidewalls 452*a* and 452*b* depend downwardly from edges 451*c* and 451*d*, respectively, of top 450. Sidewalls 452*a* and 452*b* each include a bottom edge 454*a* and 454*b*, respectively, which are generally vertically opposite top edges 451*c* and 451*d*, respectively.

Top 450 and sidewalls 452*a* and 452*b* bound an interior 455 of slider 448. Projecting from each sidewall toward interior 455 are a pair of opposing feet. Projecting inwardly from sidewall 452*a* is foot 456*a*, and projecting inwardly from sidewall 452*b* is foot 456*b*. Preferably, feet 456*a* and 456*b* are aligned facing each other along the length of slider 448.

The pair of feet of the slider co-act with shoulders of the fastener strips to maintain the slider engaged with the fastener strips, and further to assist in guiding the sliding motion of the slider along fastener strips. Referring to FIG. 1B, shoulders 45 and 47 are located within the corners formed by the union of foot 456*b* and sidewall 452*b* and foot 456*a* and sidewall 452*a*, respectively. Any attempt to vertically lift slider 448 from strips 32 and 34 is resisted by interference of shoulders 45 and 47 with feet 456*b* and 456*a*, respectively.

Figure 33:
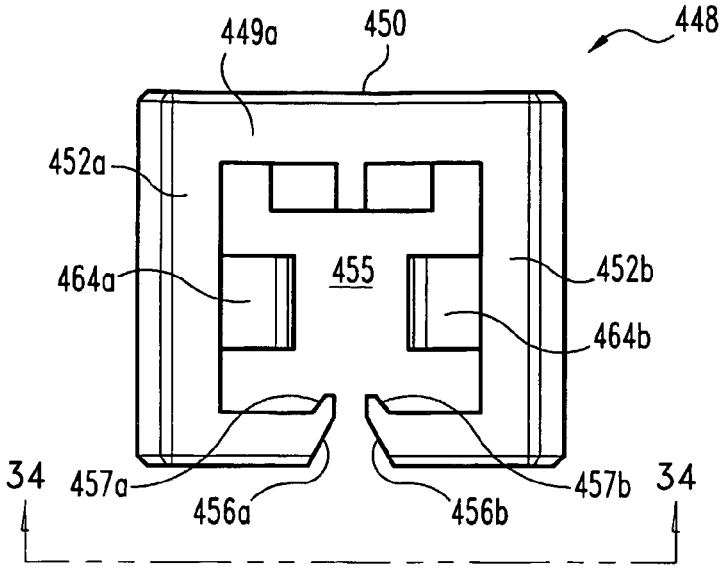
FIG. 33 is an end elevational view of the slider of FIG. 29, including certain exemplary dimensions.

Slider 448 incorporates various improvements which reduce the possibility a user will inadvertently pull slider 448 off of a pair of fastener strips. As best seen in FIG. 33, each foot 456*a* and 456*b* includes an upstanding projection or lip 457*a* and 457*b*, respectively. These projections 457*a* and 457*b* extend generally toward interior 455 of slider 448 from a generally horizontal central portion of feet 456*a* and 456*b*, respectively. Further, although FIG. 33 depicts an upwardly angled projection with substantially linear surfaces, the present invention also contemplates the use of a hook-shaped cross section, including radiused or rounded portions.

Separator 462 of slider 448 includes a nose section 462*b* which extends from the triangular- or wedge-shaped portion of separator 462 to the face of the closing end 449*a*. A nose 462*b* that extends flush to the face of closing end 449*a* limits the maximum travel of slider 448. For example, as best considered in reference to FIG. 1A, movement of a slider 448 toward endstop 36 results in contact of nose 462*b* with the innermost fused area of endstop 36. This contact limits the sliding travel of slider 448, making it more difficult for a user to slide slider 448 such that a portion of the feet are no longer in contact with the fastener strip shoulder, and thus more difficult to pull slider 448 out of engagement with fastener strips 32 and 34.

Figure 34:
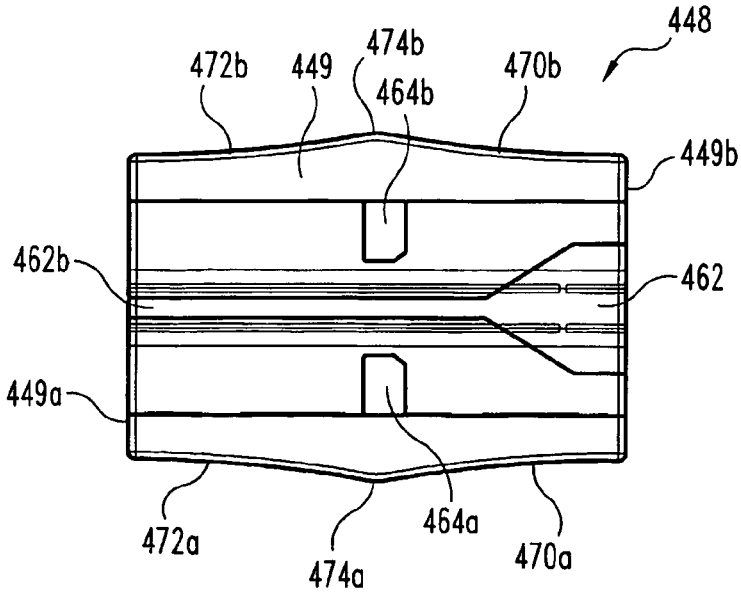
FIG. 34 is a bottom plan view of the slider of FIG. 33 as taken in the direction of the arrows along line 34-34 of FIG. 33, and including certain exemplary dimensions.
Figure 35:
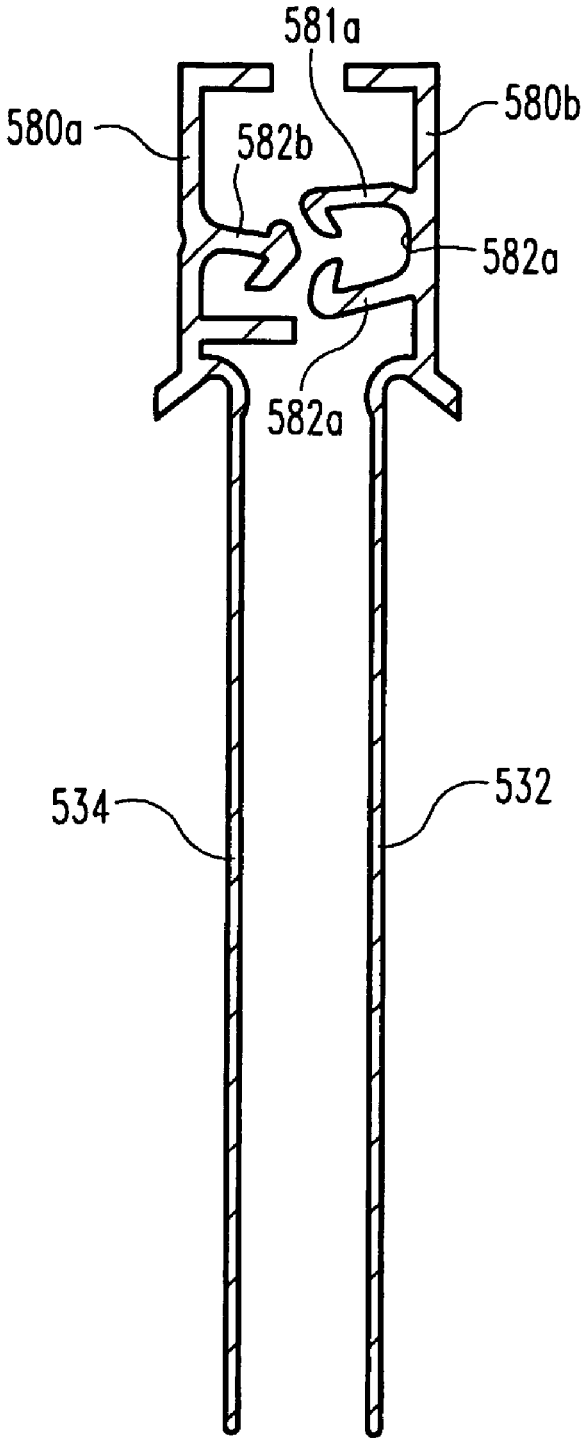
FIG. 35 is a cross sectional view of an alternative embodiment of fastener profiles for a reclosable container with the profiles unlocked.

As best seen in FIG. 34, closing bars 464*a* and 464*b* project inwardly from longitudinal midpoints of sidewalls 452*a* and 452*b* toward interior 455. Preferably, closing bars 464*a* and 464*b* are located vertically between the bottom surface of separator 462 and the top surface of feet 456*a* and 456*b*, as best seen in FIG. 33. This manner of vertical location facilitates the use of a dieset for injection molding that couples together along the longitudinal axis of the slider (i.e., a dieset that couples together in a direction parallel to the length of the fastener strips).

Slider 448 includes features with different vertical orientations to facilitate injection molding by a pair of dies that couple together in a longitudinal direction (i.e. the dies come together such that one die approaches from opening side 449*b* toward another die that approaches from closing side 449*a*). In this manner, it is possible to mold certain features, such as the lowered elevational portion of the feet between the innermost projections (457*a* and 457*b*) and the inner surface of the walls of the slider body (452*a* and 452*b*, respectively), that are difficult to fabricate with dies that approach each other vertically. This difficulty arises because of the vertical alignment of closing bars 464*a* and 464*b* directly above the interior surfaces of feet 456*a* and 456*b*, respectively. In contrast, in one embodiment of the present invention the dies approach each other longitudinally, and the open, interior volume beneath the bottom of the closing bars and the top of the angled feet is easily reproduced by a complementary-shaped solid portion of a longitudinally-approaching die member.

Slider 448 also includes exterior features which provide a more positive feel and improved gripping surface for the user, regardless of whether the slider is moved in the opening or closing direction. Slider 448 includes angled or contoured exterior surfaces 472*a* and 472*b* which extend outwardly away from interior 455 as the exterior surfaces traverse longitudinally from closing end 449*a* toward the middle of slider body 449. Likewise, the other half of the slider body includes walls 452*a* and 452*b* which include exterior surfaces 470*a* and 470*b* that extend away from interior 455 in a direction from opening end 449*b* toward a midpoint of the slider body. The juncture of outer surfaces 470*a* and 472*a* meet along a generally vertical ridge 474*a* which is preferably near a midpoint along the length of body 449. The juncture of outer surfaces 470*b* and 472*b* meet along a generally vertical ridge 474*b* which is preferably near a midpoint along the length of body 449.

As best seen in FIG. 34, ridges 474*a* and 474*b* are located a greater distance from the centerline of body 449*b* than other points along vertical walls 452*a* and 452*b*, respectively. These central ridges and angled or curving exterior walls provide for easier gripping and control of slider 448 by the user. For example, when moving the slider in a direction to interlock the profiles, the user places his fingers on the outwardly flaring wall surfaces 472*a* and 472*b* and pushes gently against ridges 474*a* and 474*b*, which is gripped more easily and with less need for surface friction than otherwise flat, planar exterior wall surfaces. As another example, when moving the slider in a direction to unlock the profiles, the user places his fingers on the outwardly flaring wall surfaces 470*a* and 470*b* and pushes gently against ridges 474*a* and 474*b*, which is gripped more easily and with less need for surface friction than otherwise flat, planar exterior wall surfaces.

In one embodiment, the present invention includes an apparatus for a reclosable container, comprising a pair of fastener strips each having a sidewall with a top, the fastener strips including a pair of opposing interlockable profile elements projecting from the sidewalls of the fastener strips and adapted and configured for repeated locking and unlocking of the fastener strips. Each fastener strip has a flange extending from a location proximate the top of the respective fastener strip. The apparatus further includes a slider comprising a body including a top with a pair of opposing sides and a central portion therebetween, a pair of opposing sidewalls, and a separator for unlocking the profile elements. Each sidewall depends downward from opposing edges of the top. The separator depends downward from the central portion of the top, and has a first portion with a first width adapted and configured for unlocking the profile elements. The separator is attached to the top by an attachment portion having a second width that is less than the first width. When the slider is coupled to the fastener strips, at least one of the flanges is able to slide between the top of the body and the first portion, and also past the attachment portion. Preferably, the flanges overlap one another when the profile strips are interlocked.

In another embodiment, the present invention includes a slider for locking and unlocking the fastener profiles of a flexible, reclosable container, comprising a body including a top and a pair of opposing sidewalls. Each of the sidewalls depend downward from the top and have a bottom edge spaced away from the top. The body has an interior bounded by the top and the sidewalls. The apparatus includes a first pair of feet for retaining the slider on the fastener profiles and guiding the slider along the fastener profiles, each of the first pair of feet projecting from a different one of the sidewalls toward the interior along the bottom edge. The apparatus includes a second pair of feet for retaining the slider on the fastener profiles and guiding the slider along the fastener profiles, each of the second pair of feet projecting from a different one of the sidewalls toward the interior along the bottom edge. The apparatus includes a third pair of feet for retaining the slider on the fastener profiles and guiding the slider along the fastener profiles, each of the third pair of feet projecting from a different one of the sidewalls toward the interior along the bottom edge. The second pair of feet are placed between and spaced apart from the first pair of feet and the third pair of feet along the bottom edge. The apparatus preferably includes a pair of closing bars, each of the bars projecting from a different one of the sidewalls toward the interior and located intermediate of the top and the respective bottom edge. The closing bars are located along the respective sidewall in between the first pair of feet and the second pair of feet. Preferably, each of the first pair of feet opposes each other, each of the second pair of feet opposes each other, and each of the third pair of feet opposes each other.

Figure 36:
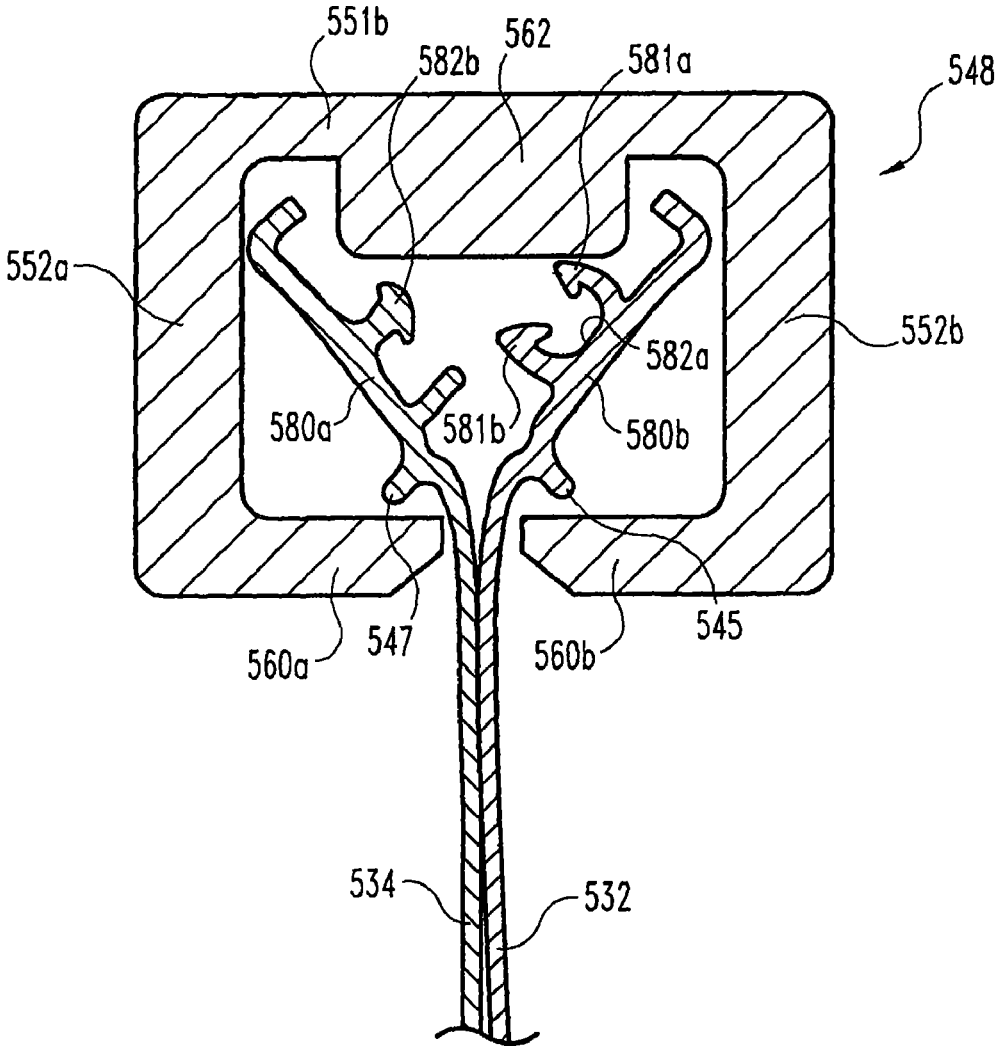
FIG. 36 is a cross sectional view similar to FIG. 1B of the fastener profiles of FIG. 36 showing the profiles in combination with the slider of FIGS. 37-42.
Figure 37:
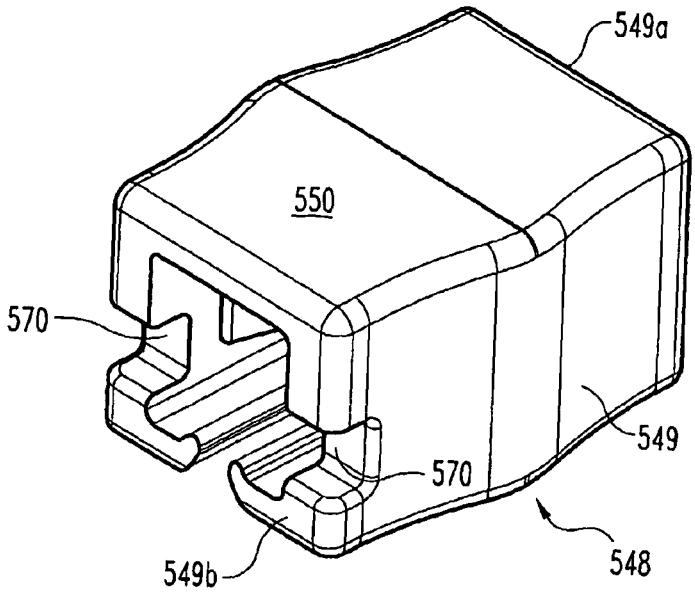
FIG. 37 is a perspective view of a slider forming another embodiment of the invention.
Figure 38:
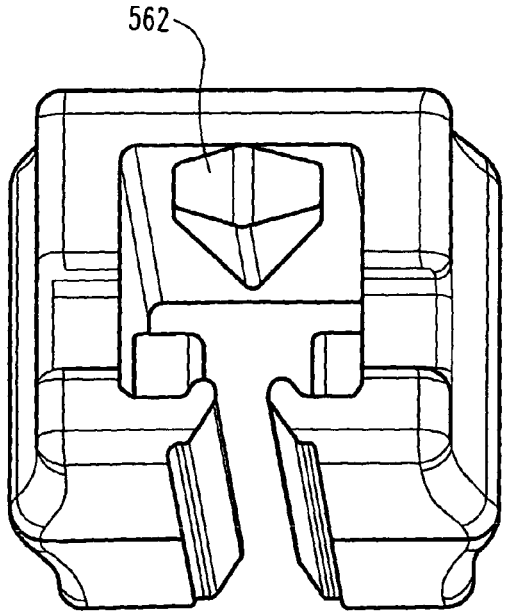
FIG. 38 is a further perspective view of the slider of FIG. 37.
Figure 39:
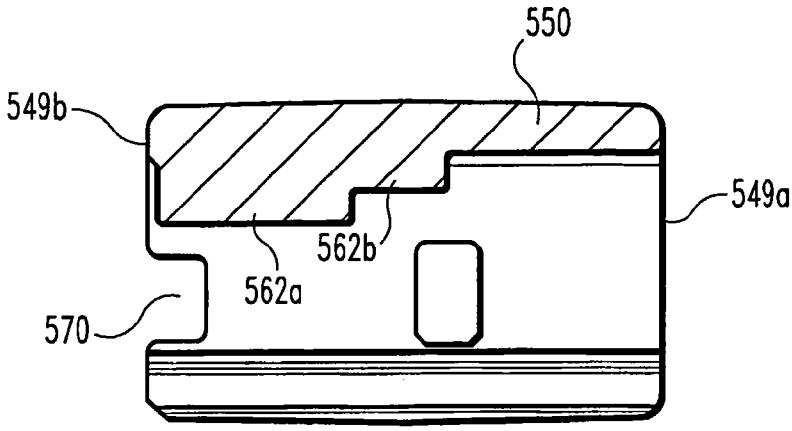
FIG. 39 is a section taken in the direction of the arrows along the line 39-39 of FIG. 40 of the slider of FIGS. 37 and 38.
Figure 40:
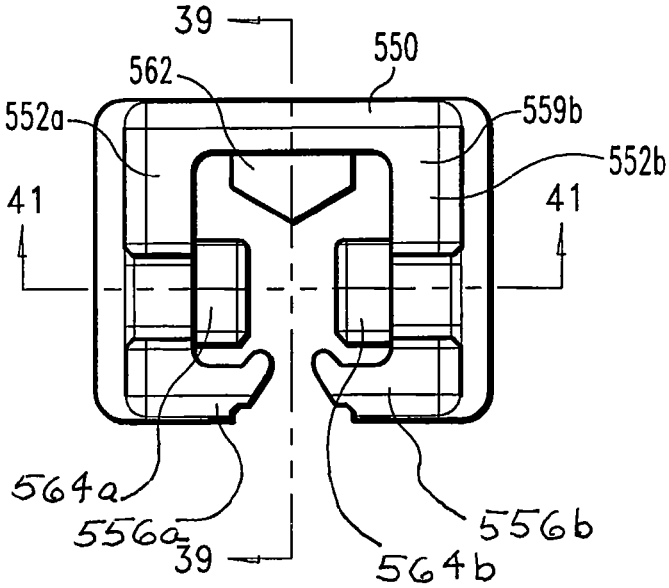
FIG. 40 is an elevation of the closing end of the slider.
Figure 41:
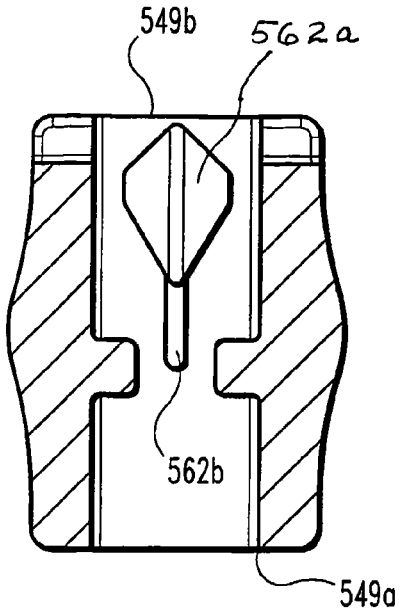
FIG. 41 is a section taken in the direction of the arrows along the line 41-41 of FIG. 40.
Figure 42:
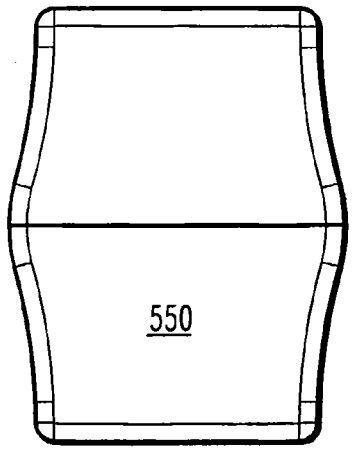
FIG. 42 is a top plan view of the slider of FIGS. 37-41.

Referring now to FIGS. 35-42, there is illustrated a further embodiment of the present invention. Referring particularly to FIG. 36 there is shown a cross sectional view similar to FIG. 1*b* of a slider 548 which is slidable upon fastener strips 532 and 534. The description and showing above with reference to FIG. 1A is also pertinent as regards the construction application and operation of the embodiment of FIGS. 35-42.

Referring to FIG. 36, slider 548 is slidable upon fastener strips 532 and 534. Fastener strips 532 and 534 include a pair of vertical walls 580*a* and 580*b*, respectively. A male profile 582*b* projects outwardly from wall 580*a*. A female profile element 582*a* projects outwardly from wall 580*b*. Slider 548 is shown enclosing non-interlocked portions of fastener strips 534 and 532. Movement of slider 548 along the fastener strips results in either an interlocking of profiles 582*a* and 582*b*, or an unlocking of profiles 582*a* and 582*b*. Female profile 582*a* includes an upper member 581*a* and also a lower member 581*b*. Slider 548 includes a separator 562 having a vertical depth from central portion 551*b* sufficient to separate elements 582*a* and 582*b* as slider 548 is moved along the fastener strips in an opening direction. Feet 560*b* and 560*a* of slider 548 retain slider 548 on the interlocking strips by shoulders 545 and 547, respectively.

Referring to FIGS. 37-42, slider 548 includes a body 549 which is preferably injection molded from a plastic material. Body 549 includes a closing end 549*a* through which passes interlocked fastener strips of a flexible, reclosable container such as that shown in FIG. 1*a*. When the slider 548 is moved in a closing direction along the fastener strips, the interlocked profiles pass out of the closing end 549*a*. Body 549 further includes an opening end 549*b* through which passes the unlocked pair of fastener profile strips as slider 548 is moved in a opening direction along the strips.

Body 549 also includes a top 550 and a pair of opposing side walls 552*a* and 552*b* which depend from the top 550. Projecting inwardly from sidewall 552*a* is foot 556*a*. Projecting inwardly from sidewall 552*b* is foot 556*b*. The feet 556*a* and 556*b* are relatively stout or thick and also extend the entire length of the slider from the closing end 549*a* to the opening end 549*b*. The single pair of feet of the slider coact with the shoulders 545 and 457 to firmly retain the slider on the fastener strips. Because the feet and 556*a* and 556*b* extend the entire length of the slider there is little tendency for the feet to become disengaged with the shoulders thus preventing or reducing pull off of the slider from the fastener strips.

The slider 548 further includes the separator 562 which as shown in FIGS. 38, 39, 40 and 41 has, at least in part, a wedge-shaped or diamond-shaped portion 562*a* and straight or elongated portion 562*b*. The separator 562 is adapted and configured to unlock and separate the profiles as shown in FIG. 36 when the slider is moved in the opening direction on the fastener strips. Mounted on the sidewalls 552*a* and 552*b* are closing bars 564*a* and 564*b* which are adapted and configured to interlock fastener strips sliding between the closing bars.

The slider 548 includes features with different vertical orientations to facilitate injection molding by a pair of dies that couple together in a longitudinal direction (i.e. the dies come together such that one die approaches from closing end 549*a* toward another die that approaches from opening end 549*b*). A pair of slots 570 are provided to facilitate orienting the sliders when it is fed in a parts feeder for assembly on the fastener strips.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. In the following claims the terms vertical, horizontal, above and the like are used not in an absolute sense but instead in a relative sense so as to orient the various elements of the claim relative to one another.

What is claimed:

1. A slider for locking and unlocking the fastener profiles of a flexible reclosable container comprising:

a body including a top and a pair of sidewalls, said body having a longitudinal direction generally parallel to the profiles, said body including a separator depending downwardly from said top for separating locked profiles, said body including a pair of closing bars for interlocking unlocked profiles;

said body further including a first pair of feet for retaining the slider on the fastener profiles and guiding the slider along the fastener profiles;

said body further including a second pair of feet for retaining the slider on the fastener profiles and guiding the slider along the fastener profiles; and said body further including a third pair of feet for retaining the slider on the fastener profiles and guiding the slider along the fastener profiles;

wherein said second pair of feet are longitudinally positioned between and spaced apart from the first and third pair of feet , said separator being longitudinally positioned between said first pair of feet and said second pair of feet, said closing bars being longitudinally positioned between said second pair of feet and said third pair of feet.

2. The slider of claim 1 wherein said top has a first gap, a second gap and a third gap; said first gap being located vertically above said first pair of feet; said second gap being located vertically above said second pair of feet; and said third gap being located vertically above said third pair of feet.

3. The slider of claim 2 wherein said top being formed in two parts which are spaced apart by said second gap, said separator being mounted on one of said parts and said closing bars on the other of said parts.

4. The slider of claim 3 which is formable by a pair of dies moving into engagement with one another by movement in a vertical direction, said slider having no gaps or recesses that are not filled by said dies when said dies are in engagement with one another to form the slider.

5. A reclosable container comprising:

a pair of fastener strips each having a sidewall with an upper portion, said fastener strips including a pair of opposing interlockable profile elements projecting from the sidewalls of the fastener strips and configured for repeated locking and unlocking of the fastener strips, each fastener strip having a flange extending from a location proximate the upper portion of the respective fastener strip;

a slider including a top, a pair of opposing sidewalls and a separator for unlocking the profile elements, said top having opposing sides and a central portion therebetween, said sidewalls depending downwardly from said two opposing sides of said top and said separator depending downwardly from the central portion of the top and having a first portion with a first width configured for unlocking the profile elements, said separator having a second portion attaching said first portion to the top, said second portion having a second width which is less than said first width; and said flanges being adjacent one another when the profile elements are interlocked, said flanges being slidable between the top and the first portion and past the second portion when said separator unlocks the profile elements, said first portion separating said flanges from the profile elements when said separator unlocks the profile elements;

wherein said slider further includes a first pair of feet for retaining the slider on the fastener profile elements and guiding the slider along the fastener profile elements;

a second pair of feet for retaining the slider on the fastener profile elements and guiding the slider along the fastener profile elements; and a third pair of feet for retaining the slider on the fastener profile elements and guiding the slider along the fastener profile elements;

wherein said second pair of feet are longitudinally positioned between and spaced apart from said first and third pair of feet.

6. The slider of claim 1 wherein said closing bars depend inwardly from said sidewalls.

7. The slider of claim 1 wherein said separator has a first portion with a first width configured for separating the profile elements, said separator having a second portion attaching said first portion to the top of said body, said second portion having a second width which is less than said first width.

8. A reclosable container comprising:

a pair of fastener strips each having a sidewall with an upper portion, said fastener strips including a pair of opposing interlockable profile elements projecting from the sidewalls of the fastener strips and configured for repeated locking and unlocking of the fastener strips, each fastener strip having a flange extending from a location proximate the upper portion of the respective fastener strip;

a slider including a top, a pair of opposing sidewalls and a separator for unlocking the profile elements, said top having opposing sides and a central portion therebetween, said sidewalls depending downwardly from said two opposing sides of said top and said separator depending downwardly from the central portion of the top and having a first portion with a first width configured for unlocking the profile elements, said separator having a second portion attaching said first portion to the top, said second portion having a second width which is less than said first width; and said flanges being adjacent one another when the profile elements are interlocked, said flanges being slidable between the top and the first portion and past the second portion when said separator unlocks the profile elements, said first portion separating said flanges from the profile elements when said separator unlocks the profile elements;

wherein said body further includes a first pair of feet for retaining the slider on the fastener strips and guiding the slider along the fastener strips, a second pair of feet for retaining the slider on the fastener strips and guiding the slider along the fastener strips; and a third pair of feet for retaining the slider on the fastener strips and guiding the slider along the fastener strips;

wherein said second pair of feet are longitudinally positioned between and spaced apart from the first and third pair of feet, said separator being longitudinally positioned between said first pair of feet and said second pair of feet.

9. The container of claim 8 wherein said slider includes closing bars longitudinally positioned between said second pair of feet and said third pair of feet.

10. The container of 5 wherein said slider includes closing bars longitudinally positioned between said second pair of feet and said third pair of feet.

11. The container of claim 10 wherein said closing bars depend inwardly from said sidewalls.

12. The container of claim 5 wherein said top has a first gap, a second gap and a third gap; said first gap being located vertically above said first pair of feet; said second gap being located vertically above said second pair of feet; and said third gap being located vertically above said third pair of feet.

13. The container of claim 12 wherein said top being formed in two parts which are spaced apart by said second gap, said separator being mounted on one of said parts and said closing bars on the other of said parts.

14. The container of claim 13 wherein said slider is formable by a pair of dies moving into engagement with one another by movement in a vertical direction, said slider having no gaps or recesses that are not filled by said dies when said dies are in engagement with one another to form the slider.

* * * * *